US007956815B2

(12) United States Patent
Ohira et al.

(10) Patent No.: US 7,956,815 B2
(45) Date of Patent: Jun. 7, 2011

(54) LOW-PROFILE ANTENNA STRUCTURE

(75) Inventors: Masataka Ohira, Soraku-gun (JP); Wuqiong Luo, Soraku-gun (JP); Makoto Taroumaru, Soraku-gun (JP); Amane Miura, Soraku-gun (JP); Shigeru Saito, Soraku-gun (JP); Masazumi Ueba, Soraku-gun (JP); Takashi Ohira, Soraku-gun (JP)

(73) Assignee: Advanced Telecommunications Research Institute International, Kyoto (JP)

( * ) Notice: Subject to any disclaimer, the term of this patent is extended or adjusted under 35 U.S.C. 154(b) by 633 days.

(21) Appl. No.: 11/969,762

(22) Filed: Jan. 4, 2008

(65) Prior Publication Data

US 2010/0045553 A1 Feb. 25, 2010

(30) Foreign Application Priority Data

Jan. 12, 2007 (JP) ..... 2007-005077

(51) Int. Cl.
*H01Q 9/04* (2006.01)
*H01Q 9/00* (2006.01)

(52) U.S. Cl. ..... 343/730; 343/700 MS; 343/702

(58) Field of Classification Search ..... 343/730, 343/702, 700 MS

See application file for complete search history.

(56) References Cited

U.S. PATENT DOCUMENTS

| | | | | |
|---|---|---|---|---|
| 6,337,668 | B1 | 1/2002 | Ito et al. | |
| 6,407,719 | B1 | 6/2002 | Ohira et al. | |
| 6,606,057 | B2 | 8/2003 | Chiang et al. | |
| 6,864,852 | B2 | 3/2005 | Chiang et al. | |
| 6,894,653 | B2 | 5/2005 | Chiang et al. | |
| 6,987,493 | B2 | 1/2006 | Chen | |
| 7,068,234 | B2 * | 6/2006 | Sievenpiper | 343/745 |
| 7,142,162 | B2 | 11/2006 | Taromaru et al. | |
| 7,683,839 | B2 * | 3/2010 | Ollikainen et al. | 343/702 |
| 2006/0022889 | A1 * | 2/2006 | Chiang et al. | 343/833 |
| 2006/0269022 | A1 * | 11/2006 | Li et al. | 375/347 |
| 2007/0268195 | A1 * | 11/2007 | Zarnowitz et al. | 343/872 |

FOREIGN PATENT DOCUMENTS

| | | |
|---|---|---|
| JP | 2002-118414 | 4/2002 |
| JP | 2005-252406 | 9/2005 |
| JP | 2005-278127 | 10/2005 |

OTHER PUBLICATIONS

Esser, D. et al., Compact reactively reconfigurable multi-port antennas, Antennas and Propagation Society International Symposium, IEEE, 2006, pp. 2309-2312.*

Nakano, H. et al., "A Small Steerable-Beam Antenna", International Symposium on Antennas and Propagation 2006, pp. 1-4.

(Continued)

*Primary Examiner* — Jacob Y Choi
*Assistant Examiner* — Darleen J Stockley

(57) ABSTRACT

A low-profile antenna structure can control its directivity with great flexibility. Excited elements 11 and 12 are symmetrically arranged on a y-axis, whereas parasitic elements 13 and 14 are symmetrically arranged on an x-axis, with respect to an origin. The excited elements, as well as the parasitic elements, each have an inverted-F antenna structure and are a distance of λ/4 apart from each other. Feed circuits 21 and 22 are respectively connected to and feed signals to the excited elements 11 and 12, such that phases of the signals to be fed are different from each other by a desired degree. Variable reactors 23 and 24 (i) are respectively connected to the parasitic elements 13 and 14, and (ii) in accordance with reactance values thereof, can each change an electrical length of the corresponding one of the parasitic elements.

10 Claims, 30 Drawing Sheets

OTHER PUBLICATIONS

Wang, Johnson J. H. et al., "Broadband/Multiband Conformal Circular Beam-Steering Array", 2006 IEEE, pp. 3338-3345.

Esser, D. et al., "Compact Reactively Reconfigurable Multi-port Antennas", 2006 IEEE, pp. 2309-2312.

Gyoda, Koichi et al., "Design of Electronically Steerable Passive Array Radiator (ESPAR) Antennas", 2000 IEEE, 4 Pages.

Harrington, Roger F., "Reactively Controlled Directive Arrays", IEEE Transactions on Antennas and Propagation, vol. AP-26, No. 3, May 1978, pp. 390-395.

Vaughan, Rodney, "Switched Parasitic Elements for Antenna Diversity", IEEE Transactions on Antennas and Propagation, vol. 47, No. 2, Feb. 1999, pp. 399-405.

Dinger, Robert J., "Reactively Steered Adaptive Array Using Microstrip Patch Elements at 4 GHz", IEEE Transactions on Antennas and Propagation, vol. AP-32, No. 8, Aug. 1984, pp. 848-856.

Japanese Application No. 2007-220347 Office Action dated Feb. 1, 2011,3 pages.

* cited by examiner

12

13

$X_3 > X_4$ $X_3 < X_4$ $\phi_n$=180deg.

$A_1$=1.39
$\phi_1$=−24.6
$A_2$=1.00
$\phi_2$=−58.0
$X_3$=31
$X_4$=−29

$\phi_n$=210deg.

$A_1$=1.09
$\phi_1$=−61.1
$A_2$=1.00
$\phi_2$=−37.9
$X_3$=34
$X_4$=−43

$\phi_n$=240deg.

$A_1$=0.94
$\phi_1$=−34.0
$A_2$=1.00
$\phi_2$=−30.2
$X_3$=25
$X_4$=−67

$\phi_n$=270deg.

$A_1$=1.45
$\phi_1$=−15.5
$A_2$=1.00
$\phi_2$=−8.0
$X_3$=32
$X_4$=−48

$\phi_n$=300deg.

$A_1$=1.79
$\phi_1$=−2.9
$A_2$=1.00
$\phi_2$=56.7
$X_3$=51
$X_4$=−51

$\phi_n$=90deg.

$A_1$=0.95
$\phi_1$=-35.1
$A_2$=1.00
$\phi_2$=-35.5
$X_3$=23
$X_4$=-37

$\phi_n$=120deg.

$A_1$=1.25
$\phi_1$=-36.1
$A_2$=1.00
$\phi_2$=-28.5
$X_3$=26
$X_4$=-40

$\phi_n$=180deg.

$A_1$=0.95
$\phi_1$=-53.2
$A_2$=1.00
$\phi_2$=-0.7
$X_3$=35
$X_4$=-34

$\phi_n$=240deg.

$A_1$=1.27
$\phi_1$=-52.3
$A_2$=1.00
$\phi_2$=-41.8
$X_3$=50
$X_4$=-53

$\phi_n$=300deg.

$A_1$=1.70
$\phi_1$=4.7
$A_2$=1.00
$\phi_2$=64.4
$X_3$=57
$X_4$=-48

$\phi_n$=330deg.

$A_1$=1.75
$\phi_1$=-42.0
$A_2$=1.00
$\phi_2$=67.3
$X_3$=67
$X_4$=-167

$\phi_n$=120deg.

$A_1$=1.03
$\phi_1$=−50.3
$A_2$=1.00
$\phi_2$=−33.2
$X_3$=46
$X_4$=−26

$\phi_n$=180deg.

$A_1$=1.02
$\phi_1$=−70.8
$A_2$=1.00
$\phi_2$=80.8
$X_3$=46
$X_4$=−40

$\phi_n$=240deg.

$A_1$=2.10
$\phi_1$=−52.4
$A_2$=1.00
$\phi_2$=−11.0
$X_3$=60
$X_4$=208

$\phi_n$=270deg.

$A_1$=1.80
$\phi_1$=−52.5
$A_2$=1.00
$\phi_2$=−17.8
$X_3$=78
$X_4$=−140

$\phi_n$=300deg.

$A_1$=2.08
$\phi_1$=−19.6
$A_2$=1.00
$\phi_2$=47.9
$X_3$=57
$X_4$=−143

$\phi_n$=360deg.

$A_1$=1.15
$\phi_1$=−73.0
$A_2$=1.00
$\phi_2$=87.4
$X_3$=−70
$X_4$=75

$\phi_n$=150deg.

$A_1$=1.42
$\phi_1$=63.5
$A_2$=1.00
$\phi_2$=-48.0
$X_3$=6
$X_4$=-249

$\phi_n$=180deg.

$A_1$=1.19
$\phi_1$=-87.5
$A_2$=1.00
$\phi_2$=81.0
$X_3$=54
$X_4$=-85

$\phi_n$=210deg.

$A_1$=1.86
$\phi_1$=-76.9
$A_2$=1.00
$\phi_2$=2.9
$X_3$=190
$X_4$=-247

$\phi_n$=240deg.

$A_1$=2.46
$\phi_1$=-35.4
$A_2$=1.00
$\phi_2$=22.8
$X_3$=130
$X_4$=80

$\phi_n$=270deg.

$A_1$=1.76
$\phi_1$=-17.5
$A_2$=1.00
$\phi_2$=21.0
$X_3$=-250
$X_4$=180

EXCITATION PHASE: $\Phi_{221} \neq \Phi_{222} = \Phi_{223}$
REACTANCE VALUE: $X_{224} = X_{225} < X_{226}$ EXCITATION PHASE: $\Phi_{221} = \Phi_{223} \neq \Phi_{222}$
REACTANCE VALUE: $X_{224} < X_{225} = X_{226}$ $\Phi_{221}=\frac{10}{9}\pi$ , $\Phi_{222}=0$ , $\Phi_{223}=\frac{10}{9}\pi$ $X_{224}=-4.4$ , $X_{225}=-245$ , $X_{226}=-245$ $\Phi_{221}=\frac{7}{12}\pi$ , $\Phi_{222}=0$ , $\Phi_{223}=0$ $X_{224}=165$ , $X_{225}=165$ , $X_{226}=-6.8$ $\Phi_{221}=\frac{10}{9}\pi$ , $\Phi_{222}=\frac{10}{9}\pi$ , $\Phi_{223}=0$ $X_{224}=-245$ , $X_{225}=-4.4$ , $X_{226}=-245$ $\Phi_{221}=0$ , $\Phi_{222}=\frac{7}{12}\pi$ , $\Phi_{223}=0$ $X_{224}=-6.8$ , $X_{225}=165$ , $X_{226}=165$ $\Phi_{221}=0$ , $\Phi_{222}=\frac{10}{9}\pi$ , $\Phi_{223}=\frac{10}{9}\pi$ $X_{224}=-245$ , $X_{225}=-245$ , $X_{226}=-4.4$ $\Phi_{221}=0$ , $\Phi_{222}=0$ , $\Phi_{223}=\frac{7}{12}\pi$ $X_{224}=165$ , $X_{225}=-6.8$ , $X_{226}=165$

7-ELEMENT DIRECTIVITY-VARIABLE ANTENNA

LOW-PROFILE ANTENNA STRUCTURE

BACKGROUND OF THE INVENTION (1) Field of the Invention

The present invention relates to a low-profile antenna structure, and in particular to an antenna structure that can electrically control the directivity thereof.

(2) Description of the Related Art

The directivity of an antenna can be changed by various methods, such as by spatially slanting and rotating the antenna, and using electricity. Examples of antennas known for employing the latter method are: a diversity antenna, which has multiple antennas with different directivities and chooses one of them; and an array antenna disclosed in Patent Reference 1 (Japanese Laid-Open Application No. 2002-118414).

Further, Patent Reference 2 (Japanese Laid-Open Application No. 2005-252406) discloses technology for making the directivity variable by magnetically coupling an excited element and a parasitic element provided on the back of a television receiver and the like.

The technology disclosed in Patent Reference 2 is effective when used in a situation where the direction from which the television receiver and the like receive an electromagnetic wave is limited to some extent. However, in the case of a mobile communication system, an antenna that has a strong directivity and does not limit the wave arrival direction is required since the Space Division Multiplexing technology (hereinafter, simply "SDM") is applied to the system. Especially, the system requires technology that controls beamforming and null-forming with great flexibility.

Moreover, in many cases, transceivers used in the mobile communication system are mobile devices, and hence are expected to become smaller. For example, antennas for RFID (Radio Frequency Identification) use have become smaller through the use of a high-frequency band at 2.45 GHz. Like in this case, an antenna element can be made smaller by using higher frequency bands. Thus, in prospect of the use of such higher frequency bands in the future, there will be a demand for an antenna structure that benefits from such a size advantage.

The antenna element of the antenna disclosed in Patent Reference 1 can be made smaller using high frequency bands. However, being composed of a dipole element or a monopole element, this antenna needs to be placed either (i) far enough from a metal case or a circuit board of the transceiver, or (ii) standing straight up on the case or the circuit board, which are regarded as ground planes. Either way, the antenna protrudes outwardly far from the transceiver, making the transceiver inconvenient to carry around.

SUMMARY OF THE INVENTION

In view of this, the present invention aims to provide a low-profile antenna structure that benefits from a size advantage gained with the use of a high frequency band, and that can control its directivity with great flexibility.

The above object is fulfilled by an antenna structure comprising: multiple low-profile excited elements that are arranged on a ground plane with a predetermined spatial relationship therebetween; multiple low-profile parasitic elements that are arranged on the ground plane with another predetermined spatial relationship therebetween, while maintaining a yet another predetermined spatial relationship with each excited element; multiple feed units each of which has been connected to and feeds a signal to a different one of the excited elements, in such a manner that phases of the signals to be fed to the excited elements are different from each other by a desired degree; and multiple variable reactors each of which (i) is connected to a different one of the parasitic elements and (ii) in accordance with a reactance value thereof, changes an electrical length of the corresponding one of the parasitic elements.

With the above configuration, the antenna structure of the present invention can provide phased array antennas by adjusting phase differences between the signals to be fed to the excited elements, and can control its directivity in the direction of the alignment of the excited elements. Meanwhile, the electrical length of each parasitic element can be changed by adjusting the variable reactors between capacitivity and inductivity. Here, each parasitic element has properties of a director when its electrical length is short, and properties of a reflector when its electrical length is long. Therefore, the antenna structure of the present invention can control its directivity, further in the direction of the alignment of the parasitic elements.

As such, the antenna structure of the present invention has characteristics of both a phased array antenna and a Yagi-Uda antenna, controlling its directivity with great flexibility. Moreover, since the excited elements and the parasitic elements are both constructed low-profile, the antenna structure of the present invention can be manufactured compact and flat, and thus is suitable for use in a mobile device as a built-in.

The above-described antenna structure may be configured as follows: a number of the excited elements and a number of the parasitic elements may be two each; and in an xy-plane formed by an x-axis and a y-axis that perpendicularly intersect with each other at an origin of the xy-plane, the two excited elements are arranged on the x-axis at equal distances from the origin, one in a positive and the other in a negative direction of the x-axis, whereas the two parasitic elements are arranged on the y-axis at equal distances from the origin, one in a positive and the other in a negative direction of the y-axis.

With the above configuration, the antenna structure can control its directivity in the x-axis direction by adjusting the phase differences between the signals to be fed to the excited elements, and in the y-axis direction by adjusting the reactance values of the variable reactors connected to the parasitic elements.

Thus, although being composed of a few elements (the number of the excited elements and the parasitic elements is four in total), the antenna structure of the present invention can steer the directivity thereof in various directions in the plane including the x-axis and the y-axis.

The above-described antenna structure may also be configured as follows: the excited elements and the parasitic elements are each an inverted-F antenna of a same outer dimension; and a distance between the origin and each excited element is equal to a distance between the origin and each parasitic element.

The above-described antenna structure may be configured as follows: the inverted-F antenna is composed of (i) two vertical conductors that stand perpendicular to the ground plane, (ii) a parallel conductor that is parallel to the ground plane and electrically connects top ends of the two vertical conductors, and (iii) a long conductor that extends parallel to the ground plane, one end thereof joined to one end of the parallel conductor, and the other end thereof sticking out in the air as an open end; the two vertical conductors and the parallel conductor are together referred to as an element body part, and the long conductor is referred to as an impedance matching part; in each excited element, the element body part is arranged on the x-axis, and the impedance matching part extends parallel to the y-axis; and in each parasitic element, the element body part is arranged on the y-axis, and the impedance matching part extends parallel to the x-axis.

The above-described antenna structure may also be configured as follows: the impedance matching parts of the two excited elements, as well as the impedance matching parts of the two parasitic elements, extend in opposite directions from each other; and one of the impedance matching parts of the two excited elements and one of the impedance matching parts of the two parasitic elements, which are adjacent to each other, extend in such a manner that the former extends toward the latter and the latter extends away from the former, or vice versa.

The above configuration provides the following effects. In the antenna structure of the present invention, the impedance matching parts of the excited elements do not take much space in the x-axis direction outside the area where their element body parts are arranged. Likewise, the impedance matching parts of the parasitic elements do no take much space in the y-axis direction outside the area where their element body parts are arranged. Due to such an element design, this antenna structure takes up less space.

The above-described antenna structure may also be configured as follows: in each excited element, one of the two vertical conductors is connected to a feed source, whereas the other one of the two vertical conductors is connected to the ground plane; and in each parasitic element, one of the two vertical conductors is connected to a variable reactor, whereas the other one of the two vertical conductors is connected to the ground plane.

The above-described antenna structure may also be configured as follows: in each excited element, a total length from a bottom end of the one of the two vertical conductors to the open end is $\lambda/4$, $\lambda$ being a wavelength of a signal to be transmitted; and the excited elements and the parasitic elements are each arranged at a distance of $\lambda/8$ from the origin of the xy-plane.

The above-described antenna structure may also be configured as follows: in each excited element and each parasitic element, the impedance matching part has been bent near the open end, in such a manner that a bent portion of the impedance matching part is parallel to the ground plane and the open end approaches the element body part of an adjacent one of the parasitic elements and the excited elements, respectively.

With the above configuration, it is possible to further reduce the space for the impedance matching parts.

For example, the impedance matching parts can be bent near their open ends, such that the bent portions are aligned with sides of a square that encloses the area where the element body parts of the excited elements and the parasitic elements are arranged. As a result, as shown in FIG. 30A, the antenna structure of the present invention can fit in the square whose sides are each $\lambda/4$ long. This way the antenna structure of the present invention is smaller in dimension (i.e., ½ in width and $1/\sqrt{3}$ in length smaller) than the invention of Patent Reference 1, which is shown in FIG. 30B.

Each feed unit may include a phase shifter that can change a phase angle of a corresponding one of the signals to be fed to the excited elements to at least $n\pi/2$ radians, n being 1, 2, 3 and 4, and to a phase angle that is other than $n\pi/2$ radians.

With the above structure, the excited elements can function as various array antennas (e.g., an end-fire array and a broadside array), and the antenna structure can control its directivity in the xy-plane with much greater flexibility.

The above-described antenna structure may also be configured as follows: the excited elements and the parasitic elements are each replaced by an antenna element with the ground plane removed; and the antenna element is (i) formed by connecting an inverted-F antenna part and an F antenna part that together have mirror symmetry with respect to a hypothetical ground plane provided therebetween, and (ii) electrically equivalent to an inverted-F antenna arranged on the ground plane.

Also, in the above-described antenna structure, at least one of the excited elements and the parasitic elements may be an inverted-L antenna, a T antenna or a patch antenna.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes embodiments of the present invention, with reference to the attached drawings.

First Embodiment

<Configuration>

Figure 1:
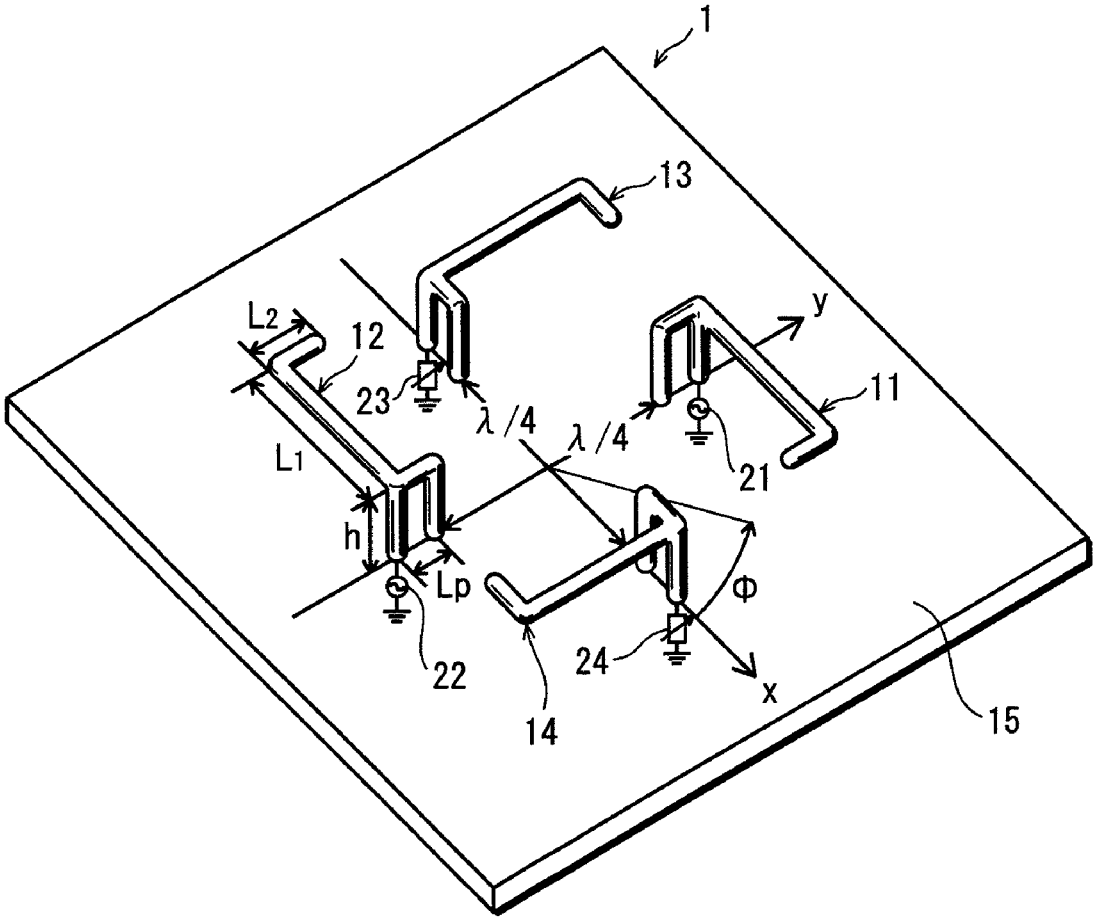
FIG. 1 shows an antenna structure 1 pertaining to a first embodiment.

FIG. 1 is a perspective view of an antenna structure 1 pertaining to the present invention.

The antenna structure 1 is composed of a metal plate (hereinafter referred to as a ground plane) 15, and excited elements 11 and 12 and parasitic elements 13 and 14 that are arranged on the ground plane 15.

In an xy-Cartesian coordinate system on the ground plane 15, the excited elements 11 and 12 are each arranged on the y-axis at a distance of λ/8 from the origin, respectively in the positive and negative directions of the y-axis (λ denotes a free-space wavelength of a transmission or reception frequency). The parasitic elements 13 and 14 are each arranged on the x-axis at the distance of λ/8 from the origin, respectively in the positive and negative directions of the x-axis. For example, when using a frequency of 2.45 GHz, the distance between the excited elements 11 and 12 is λ/4=30.5 mm.

In the present embodiment, the excited elements 11 and 12 and the parasitic elements 13 and 14 each have an inverted-F antenna structure of the same dimension.

Figure 2A:
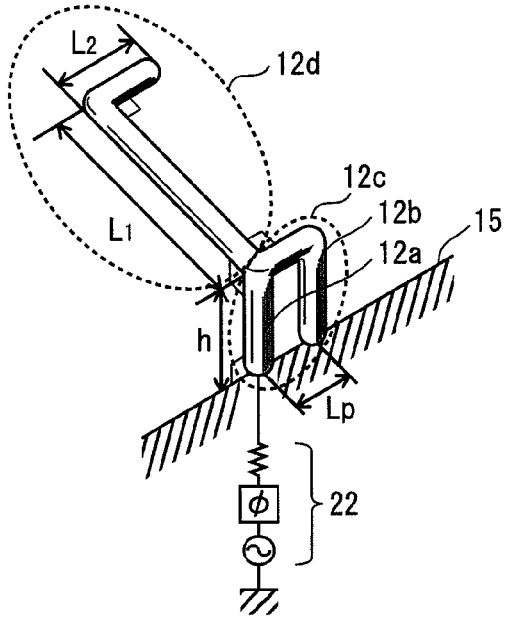
FIG. 2A schematically illustrates a structure of an excited element 11, and FIG. 2B schematically illustrates a structure of a parasitic element 13.

FIG. 2A schematically illustrates a structure of the excited element 12.

The excited element 12 includes an element body part 12*c* and an impedance matching part 12*d*.

The element body part 12*c* is composed of a first conductor 12*a* and a second conductor 12*b* that stand perpendicular to the ground plane 15, and a parallel portion that is parallel to the ground plane 15 and electrically connects top ends of the first conductor 12*a* and the second conductor 12*b*. The first and second conductors 12*a* and 12*b* stand perpendicular to the y-axis, a distance of Lp apart from each other. A feed circuit 22 feeds a signal to the bottom end of the first conductor 12*a*. The bottom end of the second conductor 12*b* is grounded to the ground plane 15.

The feed circuit 22, which is connected to the first conductor 12*a*, includes a phase shifter, and can feed the signal to the excited element 12 after adjusting the excitation amplitude and the excitation phase to given values.

Here, the parallel portion of the element body part 12*c* and the impedance matching part 12*d* are parallel to the ground plane 15. In general, components of an inverted-F antenna element that are parallel to the ground plane are nonradiative elements; hence, in the excited element 12, the first and second conductors 12*a* and 12*b*, which are perpendicular to the ground plate 15, radiate a vertically polarized wave.

The impedance matching part 12*d* extends parallel to the x-axis toward the negative direction of the x-axis, one end thereof joined to the top end of the first conductor 12*a*, and the other end thereof sticking out in the air as an open end. The impedance matching part 12*d* bends near the open end, such that a portion of the impedance matching part 12*d* that is parallel to the x-axis is L1 long, and its open end is pointed in the positive direction of the y-axis. With respect to the characteristic impedance on the feed side, favorable matching properties can be achieved by setting a total length from the bottom end of the first conductor 12*a* to the open end of the impedance matching part 12*d* (h+L1+L2) to approximately λ/4.

In the present embodiment, the length h of the first and second conductors 12*a* and 12*b*, the distance Lp between the first and second conductors 12*a* and 12*b*, and a length of the impedance matching part 12*d* (L1 plus L2) are adjusted as follows, so that the imaginary part of the input impedance of the excited element 12 becomes 0 when a frequency of 2.45 GHz is used.

h=11.0 mm (0.0900 λ)

L1=17.8 mm (0.1452 λ)

L2=4.9 mm (0.0400 λ)

Lp=2.5 mm (0.0202 λ)

The other excited element 11 is approximately identical to the excited element 12 in shape. The excited elements 11 and 12 are symmetrically arranged with respect to the origin of the xy-coordinate. Therefore, contrary to the excited element 12, the impedance matching part of the excited element 11 extends from the top end of the first conductor toward the positive direction of the x-axis, and then bends toward the negative direction of the y-axis.

Figure 2B:
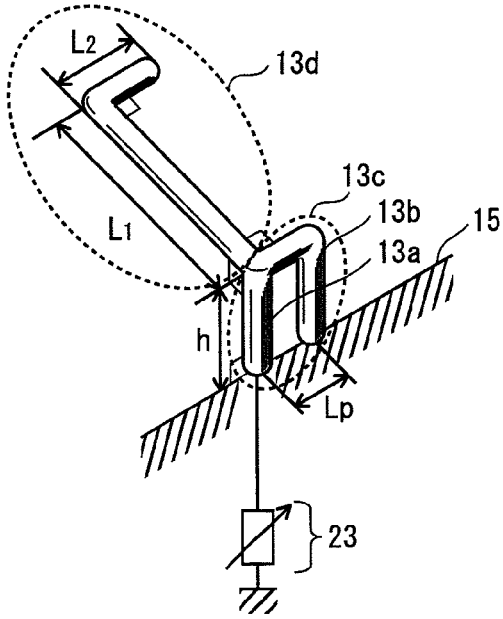

The parasitic elements 13 and 14 are also approximately identical to the excited element 12 in shape. However, as shown in the example of the parasitic element 13 in FIG. 2B, the parasitic elements 13 and 14 are different from the excited element 12 in that the bottom end of the first conductor 13*a* is grounded to the ground plane while being connected to a variable reactor 23. With a control signal from a control circuit (not illustrated), the variable reactor 23 can adjust its reactance value to a given value.

Also, in the parasitic element 13, the first and second conductors 13*a* and 13*b* stand perpendicular to the x-axis, a distance of Lp apart from each other. The impedance matching part 13*d* of the parasitic element 13 extends from the top end of the first conductor 13*a* toward the positive direction of the y-axis, and then bends towards the positive direction of the x-axis.

The parasitic elements 13 and 14 are symmetrically arranged with respect to the origin of the xy-coordinate. Contrary to the parasitic element 13, the impedance matching part of the parasitic element 14 extends from the top end of the first conductor toward the negative direction of the y-axis, and then bends towards the negative direction of the x-axis.

Figure 3:
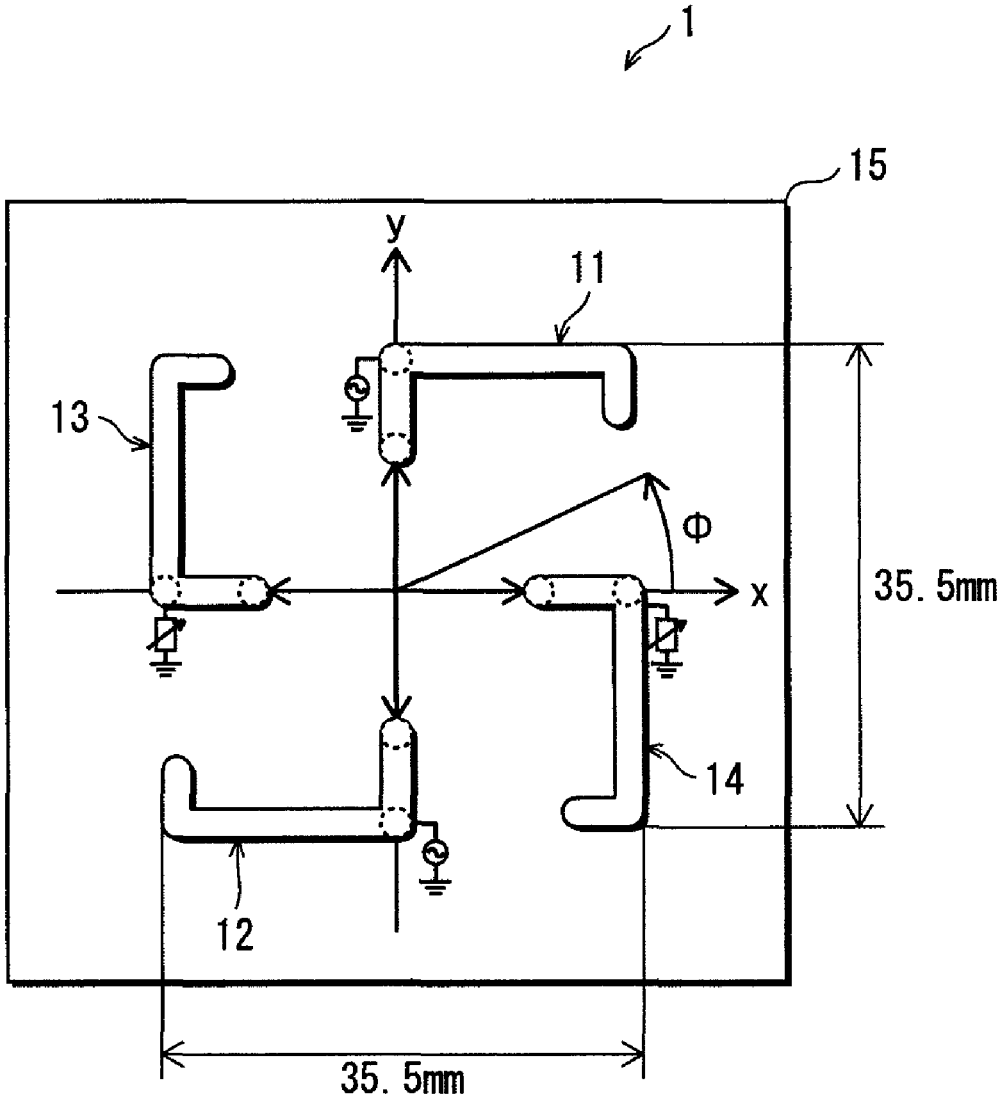
FIG. 3 shows the antenna structure 1 as viewed perpendicular to a ground plane 15 from above.

As shown in FIG. 3, when viewed perpendicular to the ground plane 15 from above, the antenna structure 1 with the above-described configuration has the excited elements 11 and 12 and the parasitic elements 13 and 14 fit in the square whose sides are each ($\lambda/4+2\times LP$)=35.5 mm long.

<Operation>

The following describes the principle of forming a beam in the x-axis direction in the above-described configuration.

Figure 4A:
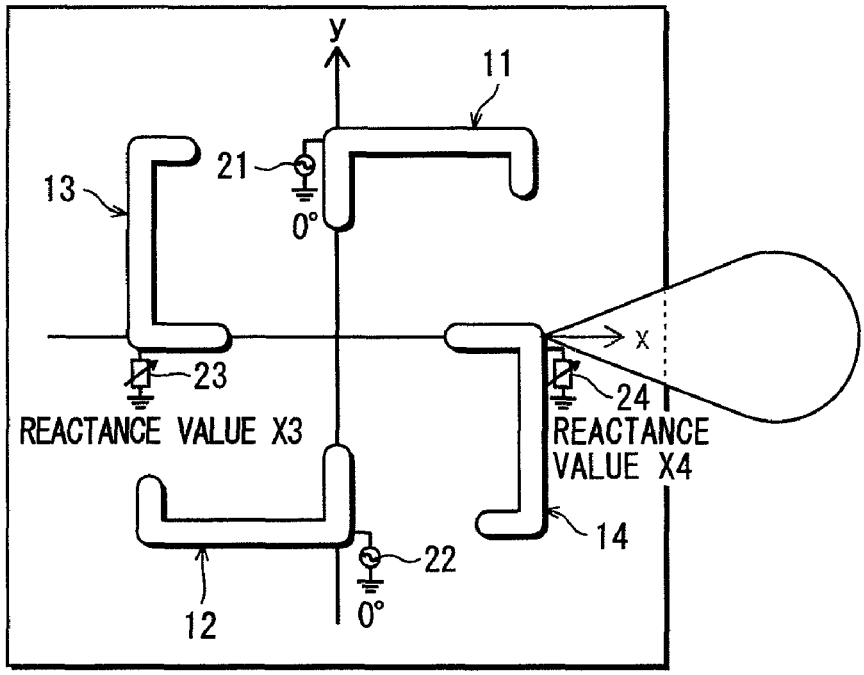
FIGS. 4A and 4B schematically illustrate the principle of forming a beam in the x-axis direction with the antenna structure 1.
Figure 4B:
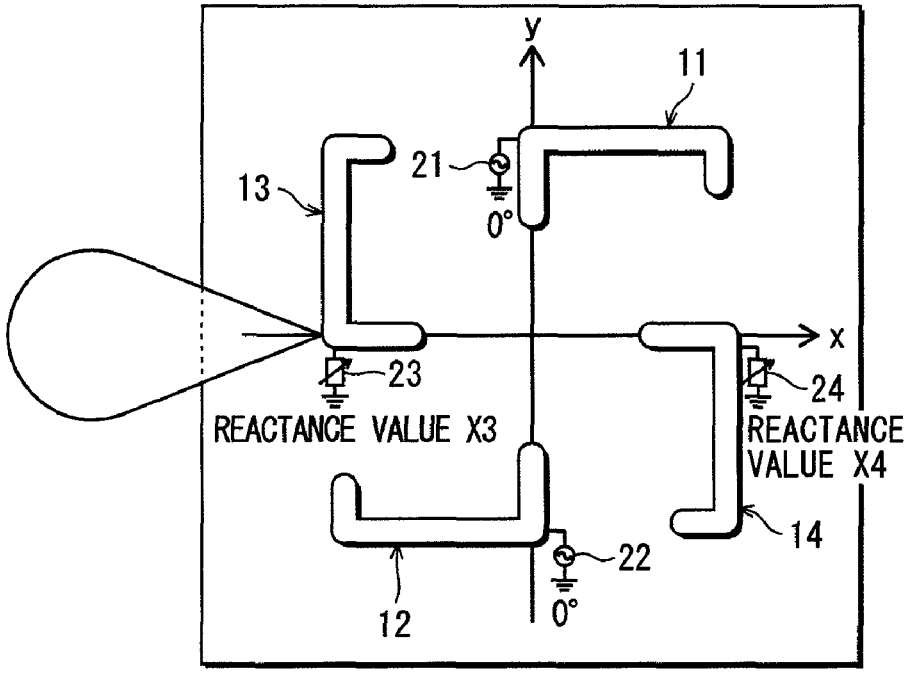

FIGS. 4A and 4B schematically illustrate the principle of forming the beam in the x-axis direction with the antenna structure 1.

The excited elements 11 and 12 function as a broadside array when excitation phases $\phi$1 and $\phi$2 of the signals to be fed are identical, causing the in-phase excitation of the signals. Here, on the xy-plane, the excited elements 11 and 12 form beams in both the positive and negative directions of the x-axis.

By changing the reactance values X3 and X4 of the variable reactors 23 and 24 connected to the parasitic elements 13 and 14, electrical lengths of the parasitic elements 13 and 14 change in accordance with the corresponding reactance values. More specifically, when the reactance values X3 and X4 are each adjusted to a negative value so as to make the variable reactors 23 and 24 capacitive, electrical lengths of the parasitic elements 13 and 14 become shorter than those of the excited elements, with the result that the parasitic elements 13 and 14 have properties of a director. On the other hand, when the reactance values X3 and X4 are each adjusted to a positive value so as to make the variable reactors 23 and 24 inductive, the electrical lengths of the parasitic elements 13 and 14 become longer than those of the excited elements, with the result that the parasitic elements 13 and 14 have properties of a reflector.

Therefore, while the excited elements 11 and 12 are functioning as the broadside array due to the in-phase excitation, it is possible to cause the antenna structure 1 function the same as a Yagi-Uda antenna by changing the electrical lengths of the parasitic elements 13 and 14 toward the opposite lengths, the parasitic elements 13 and 14 being arranged opposite to each other in the positive and negative directions of the x-axis respectively. This causes the parasitic elements 13 and 14 to respectively function as the director and the reflector, or vise versa.

More specifically, as shown in FIG. 4A, it is possible to form a beam in the positive direction of the x-axis by (i) the feed circuits 21 and 22 feeding the in-phase signals and (ii) increasing the reactance value X3 of the variable reactor 23 while reducing the reactance value X4 of the variable reactor 24. Conversely, as shown in FIG. 4B, it is possible to form a beam in the negative direction of the x-axis by (i) the feed circuits 21 and 22 feeding the in-phase signals and (ii) reducing the reactance value X3 of the variable reactor 23 while increasing the reactance value X4 of the variable reactor 24.

Figure 5A:
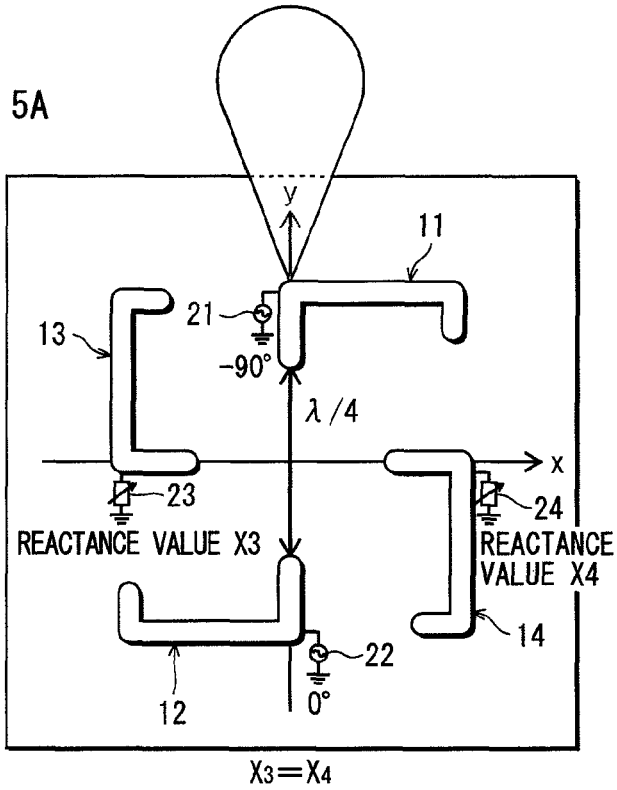
FIGS. 5A and 5B schematically illustrate the principle of forming a beam in the y-axis direction with the antenna structure 1.
Figure 5B:
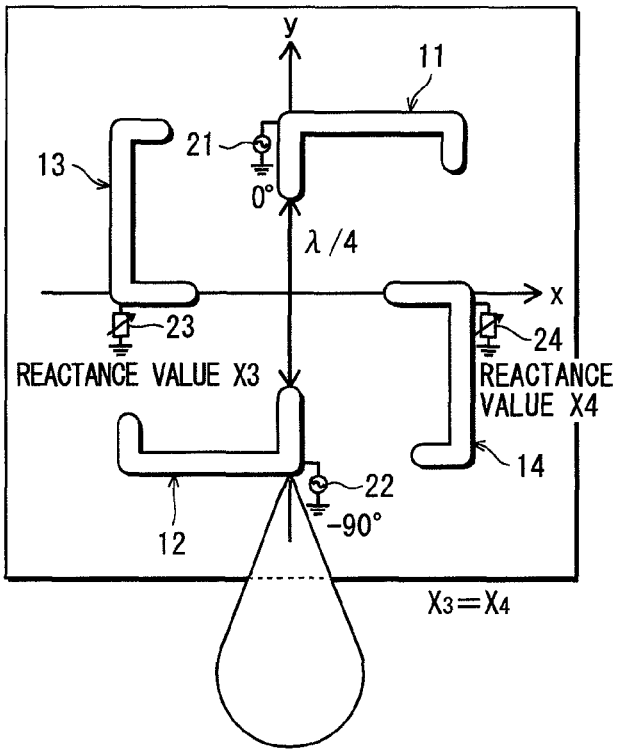
Figure 6A:
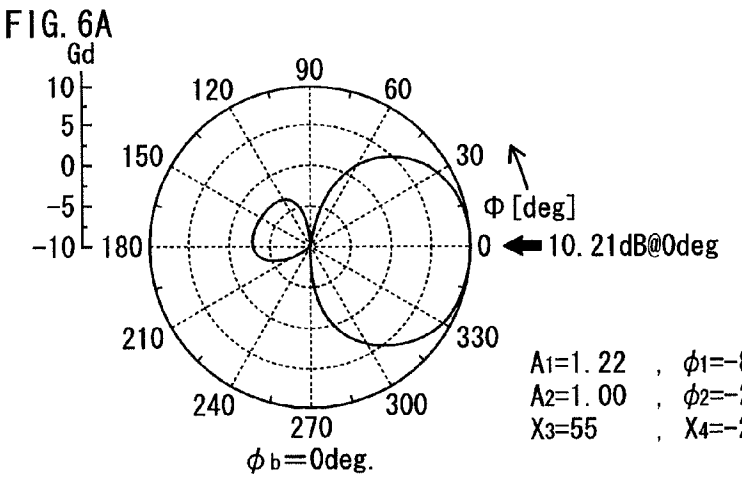
FIGS. 6A through 6D illustrate directive gains Gd that are achieved when beams are formed in the directions corresponding to azimuthal angles of $\Phi=0°$-$90°$.
Figure 6B:
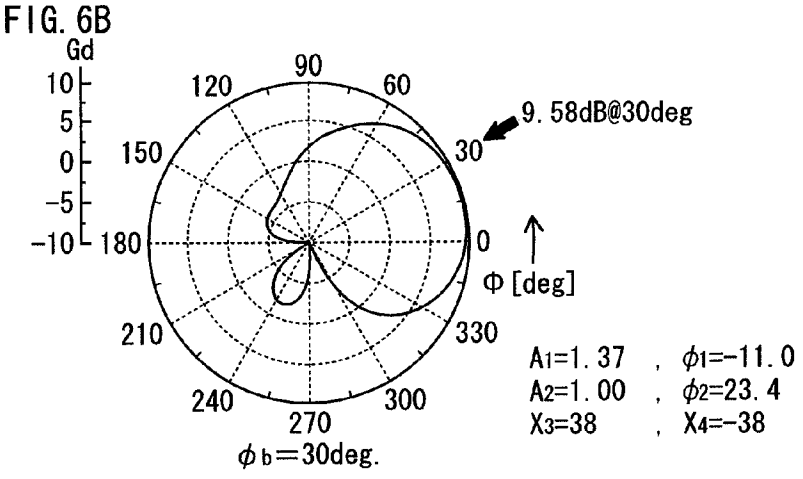
Figure 6C:
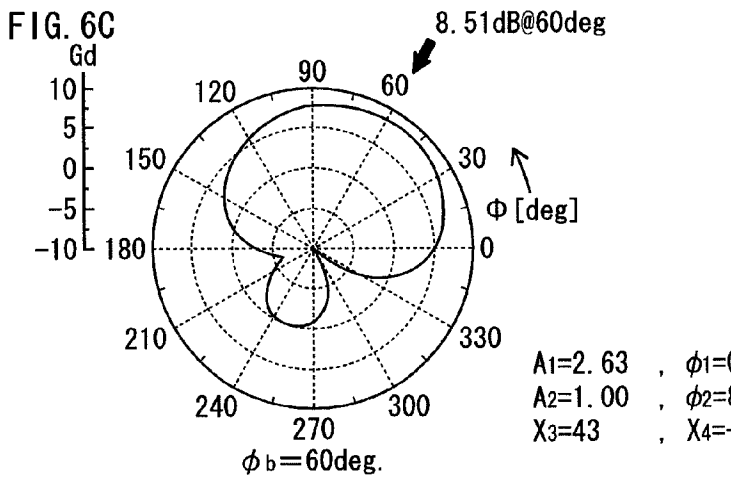
Figure 6D:
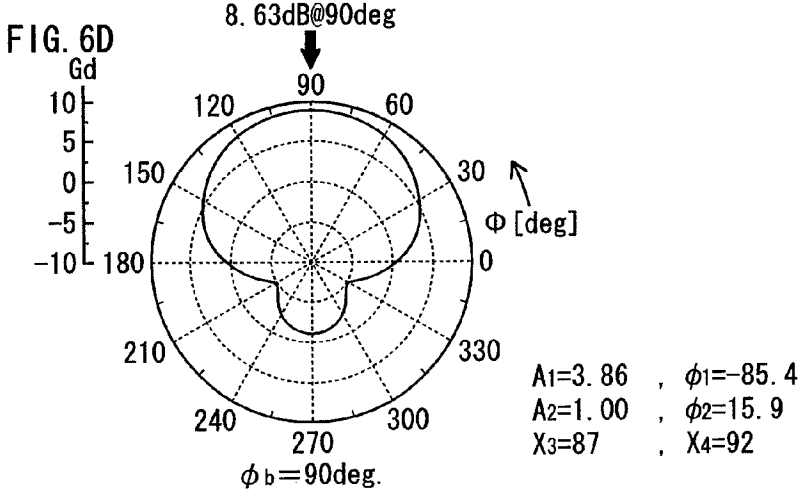
Figure 7A:
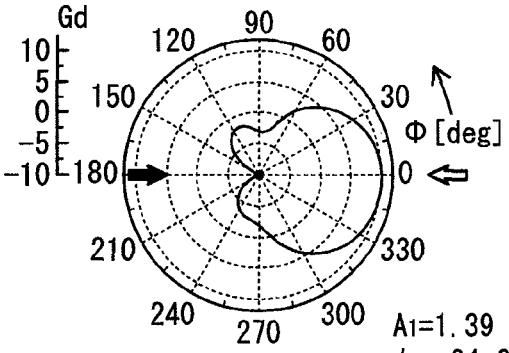
FIGS. 7A through 7E illustrate directive gains Gd that are achieved when the beam is fixed in the direction corresponding to an azimuthal angle of $\Phi=0°$ while a null is formed in other directions.
Figure 7B:
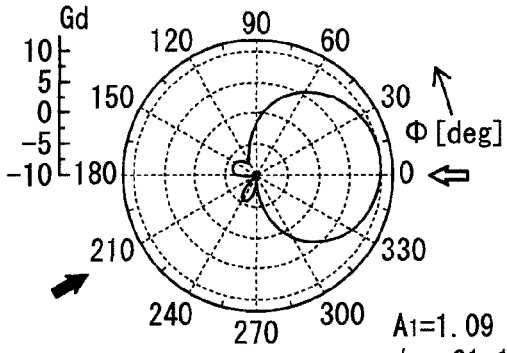
Figure 7C:
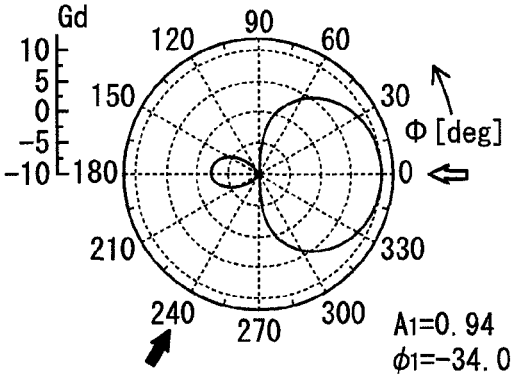
Figure 7D:
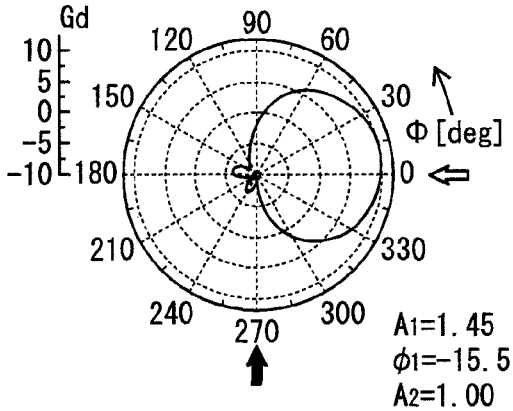
Figure 7E:
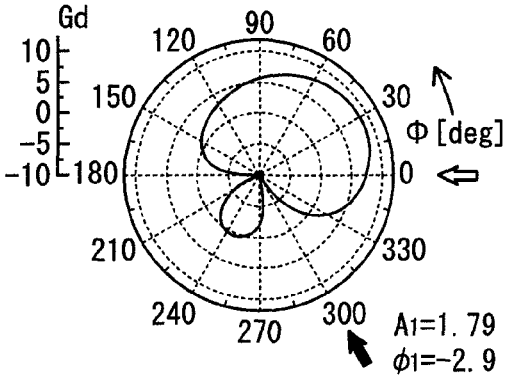
Figure 8A:
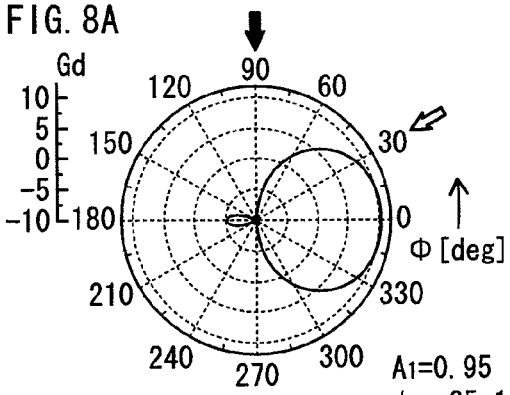
FIGS. 8A through 8F illustrate directive gains Gd that are achieved when the beam is fixed in the direction corresponding to an azimuthal angle of $\Phi=30°$ while the null is formed in other directions.
Figure 8B:
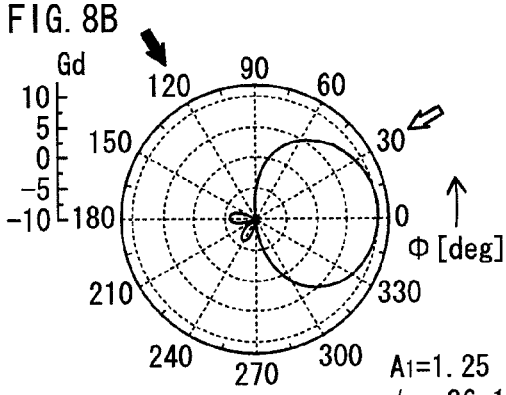
Figure 8C:
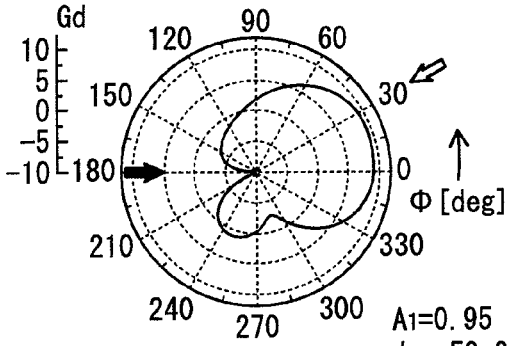
Figure 8D:
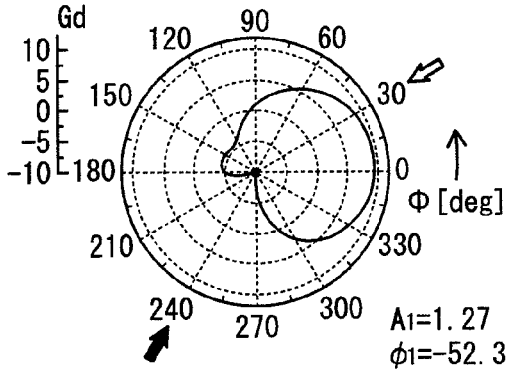
Figure 8E:
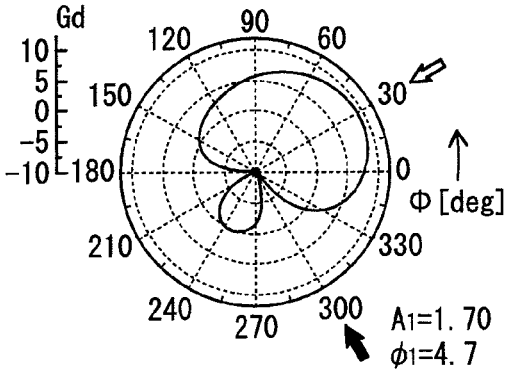
Figure 8F:
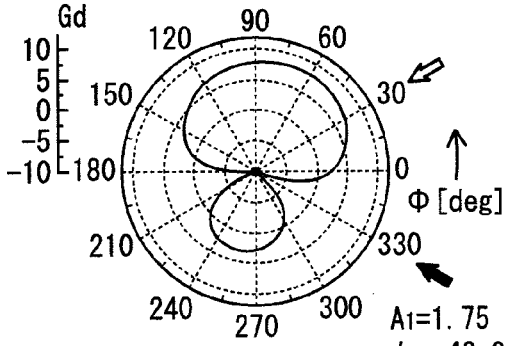
Figure 9A:
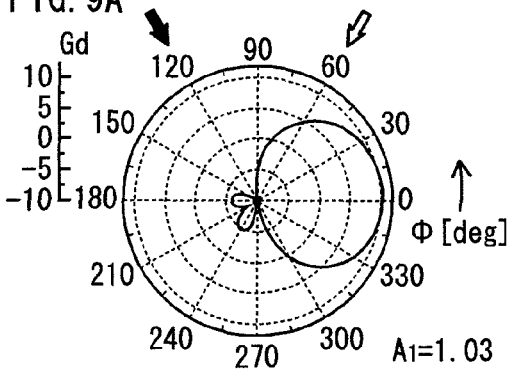
FIGS. 9A through 9F illustrate directive gains Gd that are achieved when the beam is fixed in the direction corresponding to an azimuthal angle of $\Phi=60°$ while the null is formed in other directions.
Figure 9B:
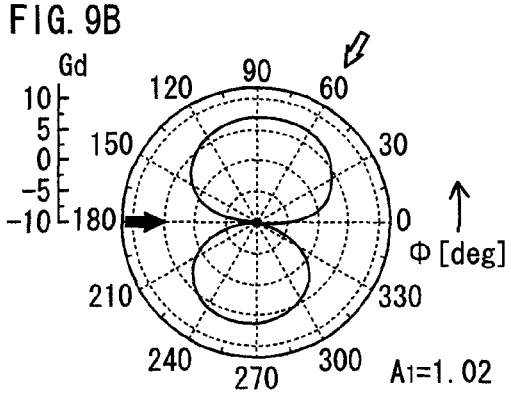
Figure 9C:
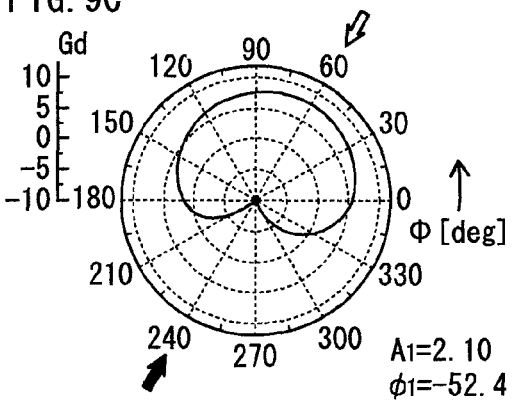
Figure 9D:
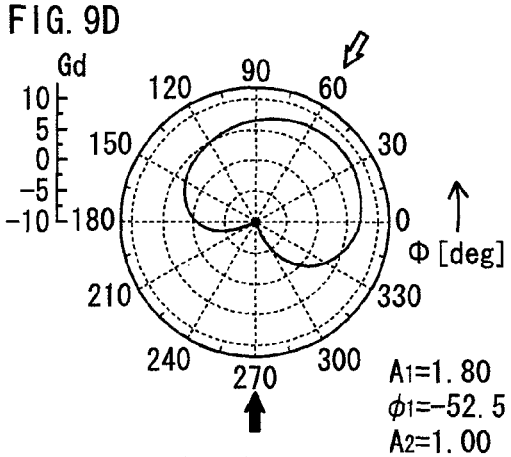
Figure 9E:
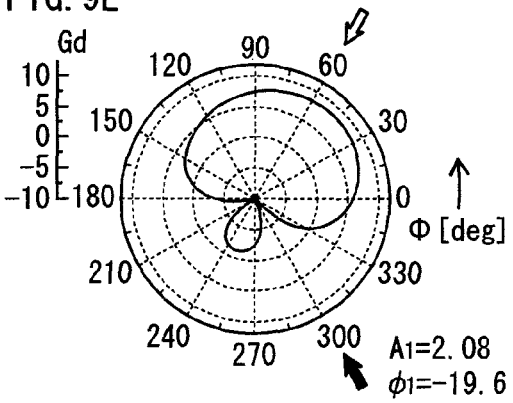
Figure 9F:
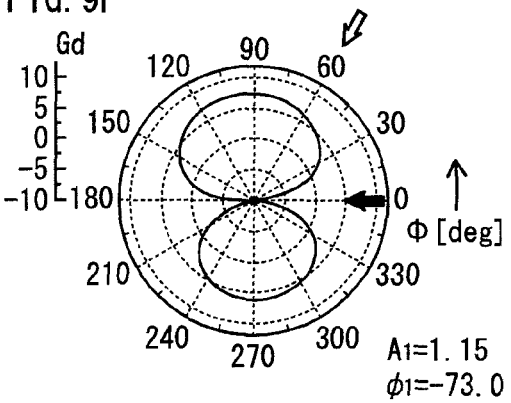
Figure 10A:
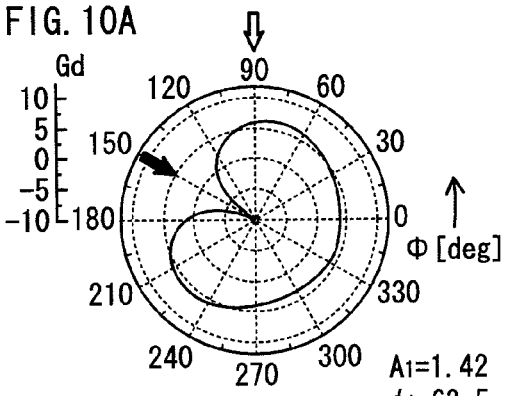
FIGS. 10A through 10E illustrate directive gains Gd that are achieved when the beam is fixed in the direction corresponding to an azimuthal angle of $\Phi=90°$ while the null is formed in other directions.
Figure 10B:
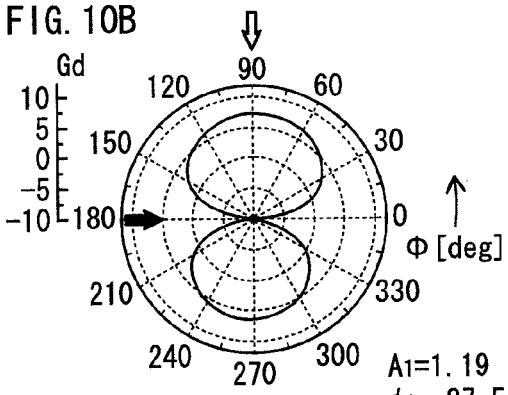
Figure 10C:
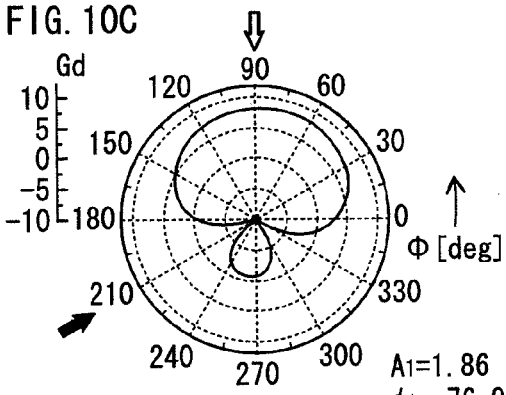
Figure 10D:
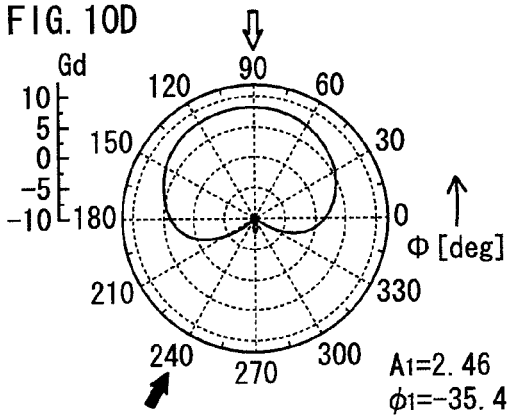
Figure 10E:
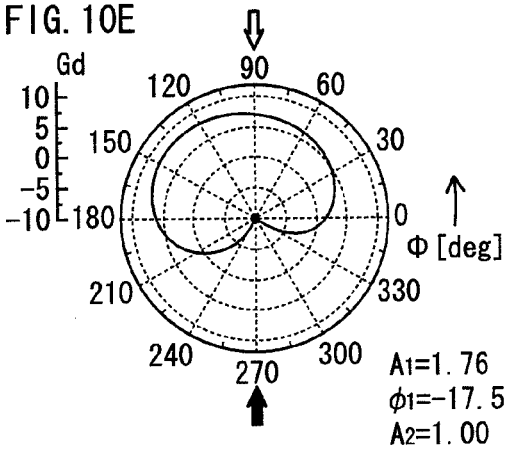

Described below is the principle of forming a beam in the y-axis direction in the above-described configuration. FIGS. 5A and 5B schematically illustrate the principle of forming a beam in the y-axis direction with the antenna structure 1.

The excited elements 11 and 12 are a distance of $\lambda/4$ apart from each other. Thus, when the excitation phases $\phi$1 and $\phi$2 of the signals to be fed to the excited elements 11 and 12 are set to be different from each other by 90°, the excited elements 11 and 12 function as an end-fire array and form a beam in the positive or negative direction of the y-axis.

Therefore, it is possible to cause the antenna structure 1 function the same as a phased array antenna composed of two excited elements, when the following is satisfied: (i) the reactance values X3 and X4 of the variable reactors 23 and 24 are adjusted to the same value, such that the parasitic elements 13 and 14 have the same properties and function with the y-axis being their axis of symmetry; and (ii) the phase difference between the excitation phases $\phi$1 and $\phi$2 is set to 90°, so as to cause the excited elements 11 and 12 function as the end-fire array.

More specifically, as shown in FIG. 5A, abeam can be formed in the positive direction of the y-axis by matching the reactance values X3 and X4 of the variable reactors 23 and 24, and then delaying the phase of the signal fed by the feed circuit 21 behind the phase of the signal fed by the feed circuit 22 by 90°. Conversely, as shown in FIG. 5B, a beam can be formed in the negative direction of the y-axis by matching the reactance values X3 and X4 of the variable reactors 23 and 24, and then advancing the phase of the signal fed by the feed circuit 21 ahead the phase of the signal fed by the feed circuit 22 by 90°.

Further, with the above-described configuration, the antenna structure 1 can also control its directivity by adjusting the excitation amplitudes A1 and A2 of the signals that the feed circuits 21 and 22 feed to the excited elements 11 and 12. Adjusting these excitation amplitudes A1 and A2 together with the excitation phases $\phi$1 and $\phi$2 and the reactance values X3 and X4 will result in the beam-forming control with greater flexibility.

FIGS. 6A through 10E illustrate directive gains Gd of the antenna structure 1 in a horizontal plane, which are calculated by using NEC (Numerical Electromagnetic Code), a program for the analysis of the electromagnetic field based on the method of moments. Referring to FIGS. 6A through 10E, the unit of A1 and A2 is [V], $\phi$1 and $\phi$2 [deg], X3 and X4 [Ω], and Gd [dB]. An azimuthal angle Φ can be measured on the basis that the positive direction of the x-axis is 0°.

When parameters A1, A2, $\phi$1, $\phi$2, X3 and X4 are adjusted to the values shown in FIGS. 6A through 6D, the antenna structure 1 forms beams in the directions that correspond to azimuthal angles of Φ=0°, 30°, 60° and 90°. When the parameters A1 and A2, parameters $\phi$1 and $\phi$2, and parameters X3 and X4 shown in FIGS. 6A through 6D are reversed between the feed circuits and the variable reactors symmetrically positioned with respect to the y-axis, origin, or x-axis, the antenna structure 1 can also form beams in the direction corresponding to azimuthal angles of 90° through 180°, 180° through 270°, and 270° through 360°.

It can been seen from the foregoing that the antenna structure 1 can form a beam in an arbitrary direction in the horizontal xy-plane, by properly adjusting the values of the excitation amplitudes A1 and A2, the excitation phases $\phi$1 and $\phi$2, and the reactance values X3 and X4.

Furthermore, when the parameters A1, A2, $\phi$1, $\phi$2, X3 and X4 are adjusted to the values shown in FIGS. 7A through 7E, the antenna structure 1 forms a beam in the direction corresponding to an azimuthal angle of Φ=0° and nulls in various directions as indicated by the black arrows.

Likewise, when the parameters A1, A2, ϕ1, ϕ2, X3 and X4 are adjusted to the values shown in FIGS. 8A through 8F, 9A through 9F, and 10A through 10E, the antenna structure 1 fixes beams in the directions corresponding to azimuthal angles of Φ=30°, 60° and 90°, and forms nulls in various directions as indicated by the black arrows.

It can been seen from the foregoing that the antenna structure 1 can not only form a beam in an arbitrary direction, but also control the direction of a null in the horizontal xy-plane with great flexibility, by properly adjusting the values of the excitation amplitudes A1 and A2, the excitation phases ϕ1 and ϕ2, and the reactance values X3 and X4.

[Modifications of First Embodiment]

The following lists other configurations of the antenna structure 1, which are fundamentally the same as the configuration thereof as described in the first embodiment, but details of which can be implemented in different ways from the first embodiment.

Figure 11:
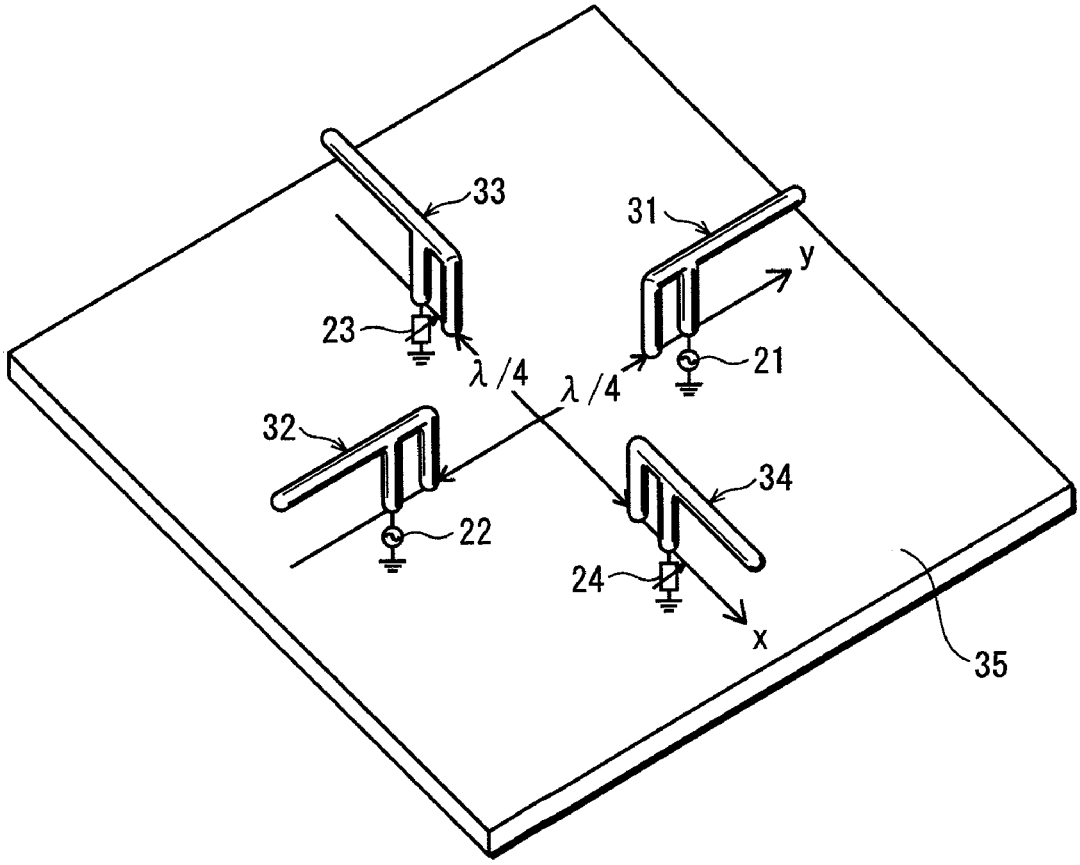
FIG. 11 shows one modification example of the first embodiment.

(1) In the configuration shown in FIG. 11, impedance matching parts of excited and parasitic elements are not bent. Impedance matching parts of excited elements 31 and 32 extend parallel to the y-axis on a ground plane 35, whereas impedance matching parts of parasitic elements 33 and 34 extend parallel to the x-axis. This antenna structure occupies a larger space than that of the first embodiment; however, as the excited and parasitic elements of this configuration are flat in a two-dimensional way, they can be cut out from a metal plate (copper, etc.). The excited and parasitic elements made using this cutout technique are suited for mass production, achieve cost reduction, and hence have practical value. Instead of these cutout elements, it is acceptable to use a printed board on which F-shaped patterns are formed.

Figure 12:
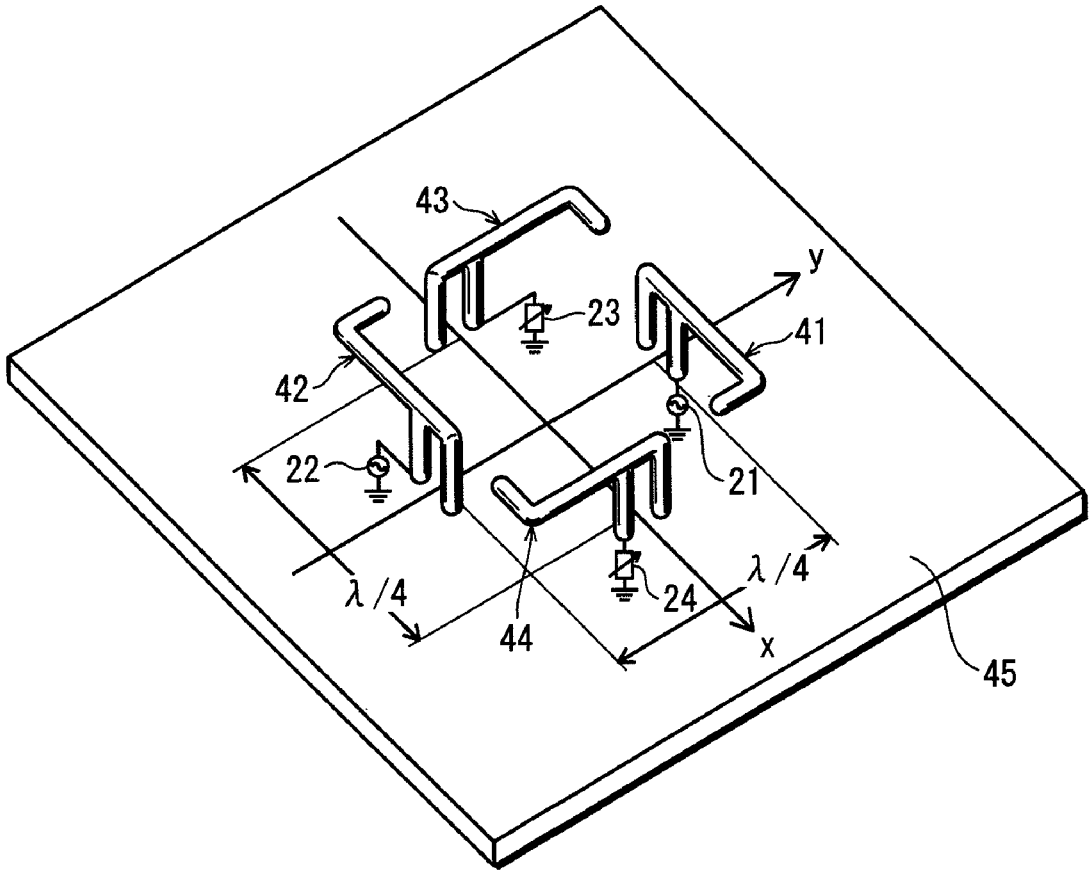
FIG. 12 shows another modification example of the first embodiment.

(2) In the configuration shown in FIG. 12, element body parts of excited elements 41 and 42 are arranged orthogonal to the y-axis, whereas element body parts of parasitic elements 43 and 44 are arranged orthogonal to the x-axis. Here, although the space occupied by the excited and parasitic elements is equal in size to that of the first embodiment, each impedance matching part does not need to extend perpendicular to the parallel portion of the corresponding element body part. Accordingly, both the excited and parasitic elements have simple shapes.

Figure 13:
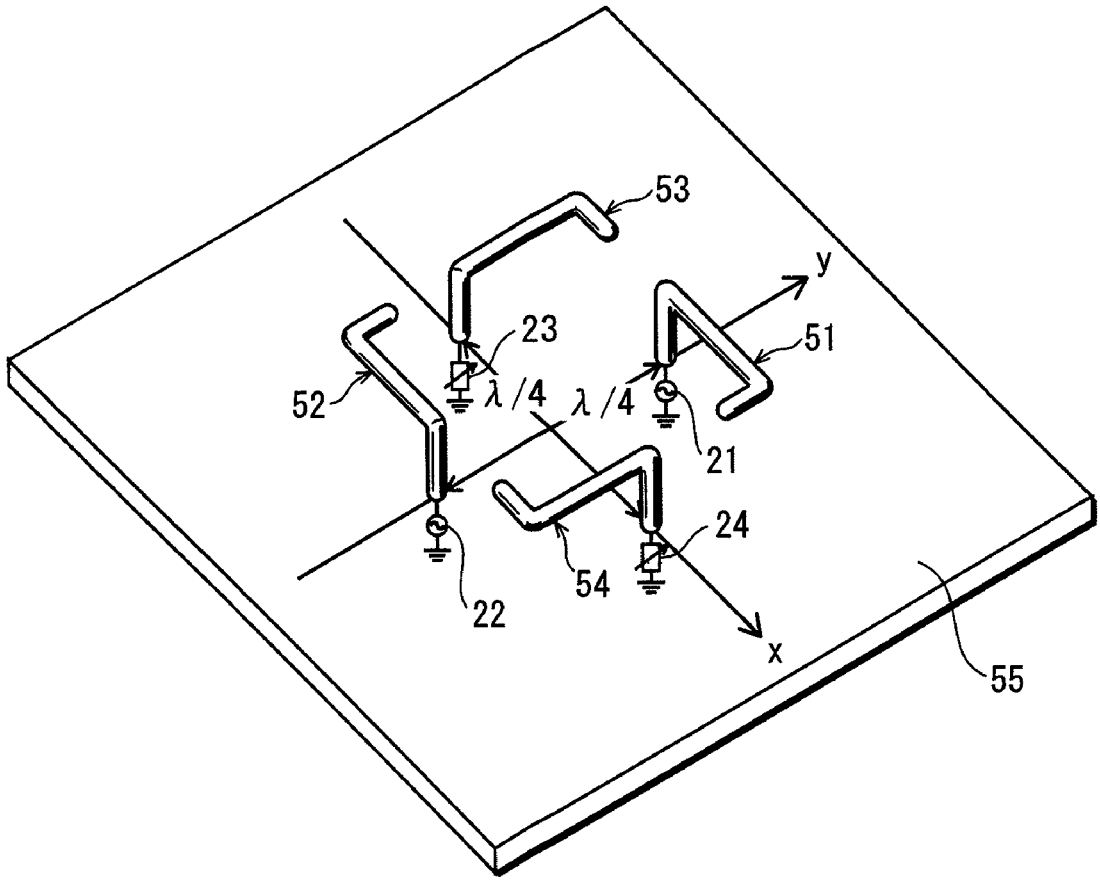
FIG. 13 shows yet another modification example of the first embodiment.

(3) In the configuration shown in FIG. 13, the excited elements 11 and 12 and the parasitic elements 13 and 14 are respectively replaced by excited elements 51 and 52 and parasitic elements 53 and 54 that each have a shape of an inverted-L antenna. Since an inverted-L antenna element can be constructed more easily than an inverted-F antenna element, such an antenna structure using the inverted-L antenna can achieve cost reduction.

Figure 14:
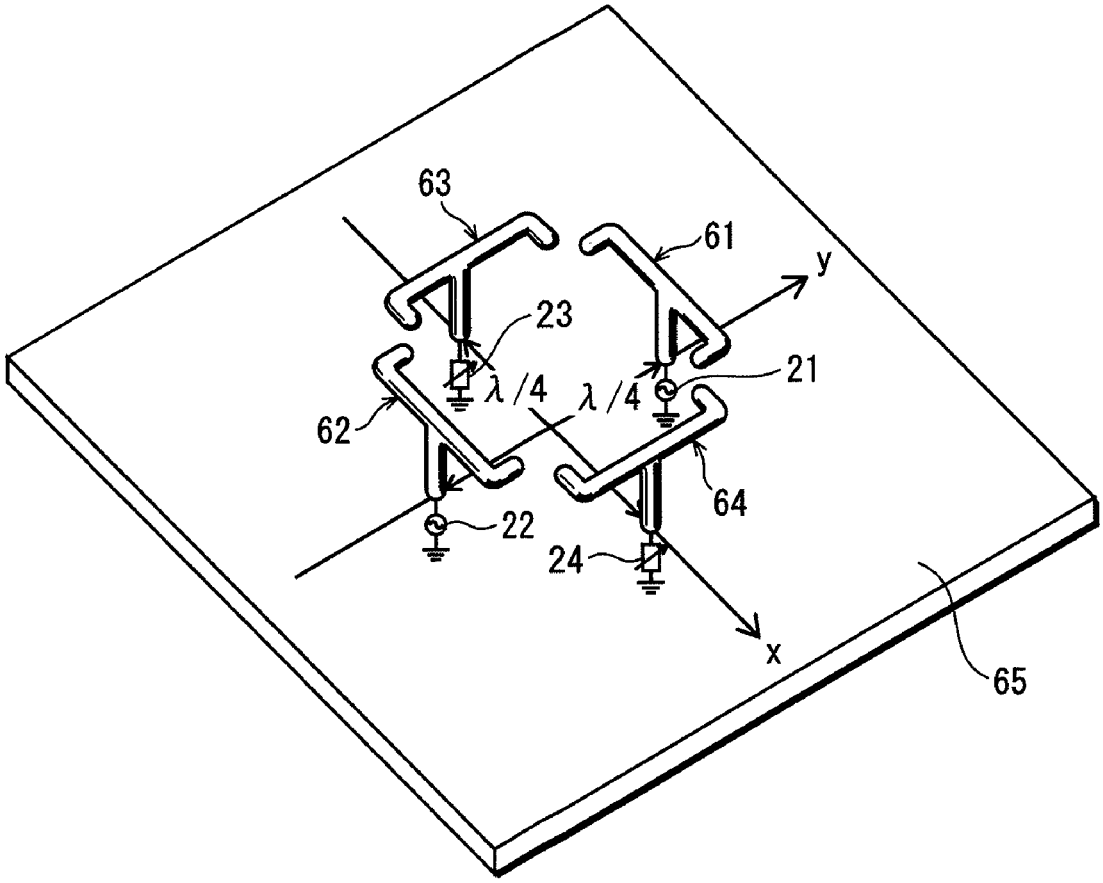
FIG. 14 shows yet another modification example of the first embodiment.

(4) In the configuration shown in FIG. 14, the excited elements 11 and 12 and the parasitic elements 13 and 14 are respectively replaced by excited elements 61 and 62 and the parasitic elements 63 and 64 that each have a shape of a T antenna. Since a T antenna element can be constructed more easily than the inverted-F antenna element used in the first embodiment, such an antenna structure using the T antenna can achieve cost reduction.

Figure 15:
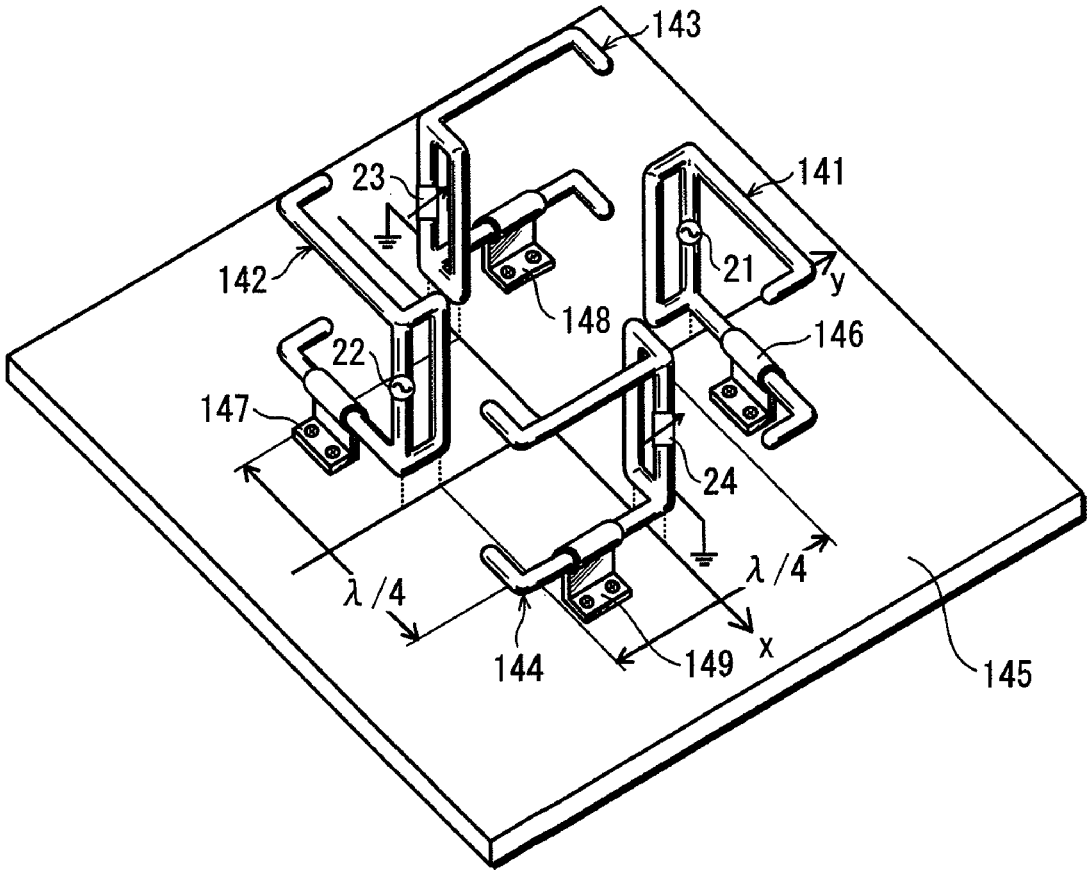
FIG. 15 shows yet another modification example of the first embodiment.

(5) In the configuration shown in FIG. 15, excited elements 141 and 142 and parasitic elements 143 and 144 respectively have the shapes of the excited elements and the parasitic elements shown in FIG. 1, but are each joined to another inverted-F antenna element so as to have mirror-image symmetry. There is no ground plane in this configuration.

Each vertical conductor of excited and parasitic elements 141, 142, 143 and 144 is twice as long as each first/second conductor of the elements pertaining to the first embodiment. However, when viewed perpendicular to a support surface 145 from above, impedance matching parts fit in the square whose sides are each 35.5 mm long, just like as described in the first embodiment. Holders 146, 147, 148 and 149 of FIG. 15 respectively hold the excited and parasitic elements 141, 142, 143 and 144 at an appropriate distance from the support surface 145. Unlike the first embodiment, the support surface 145 does not need to be a ground plane. The antenna structure of this configuration has the same electric characteristics as that of the first embodiment.

Second Embodiment

In the antenna structure 1 pertaining to the first embodiment, two excited elements and two parasitic elements are arranged on the ground plane. The second embodiment describes an antenna structure that has more antenna elements and can control its directivity with greater subtlety.

Figure 16:
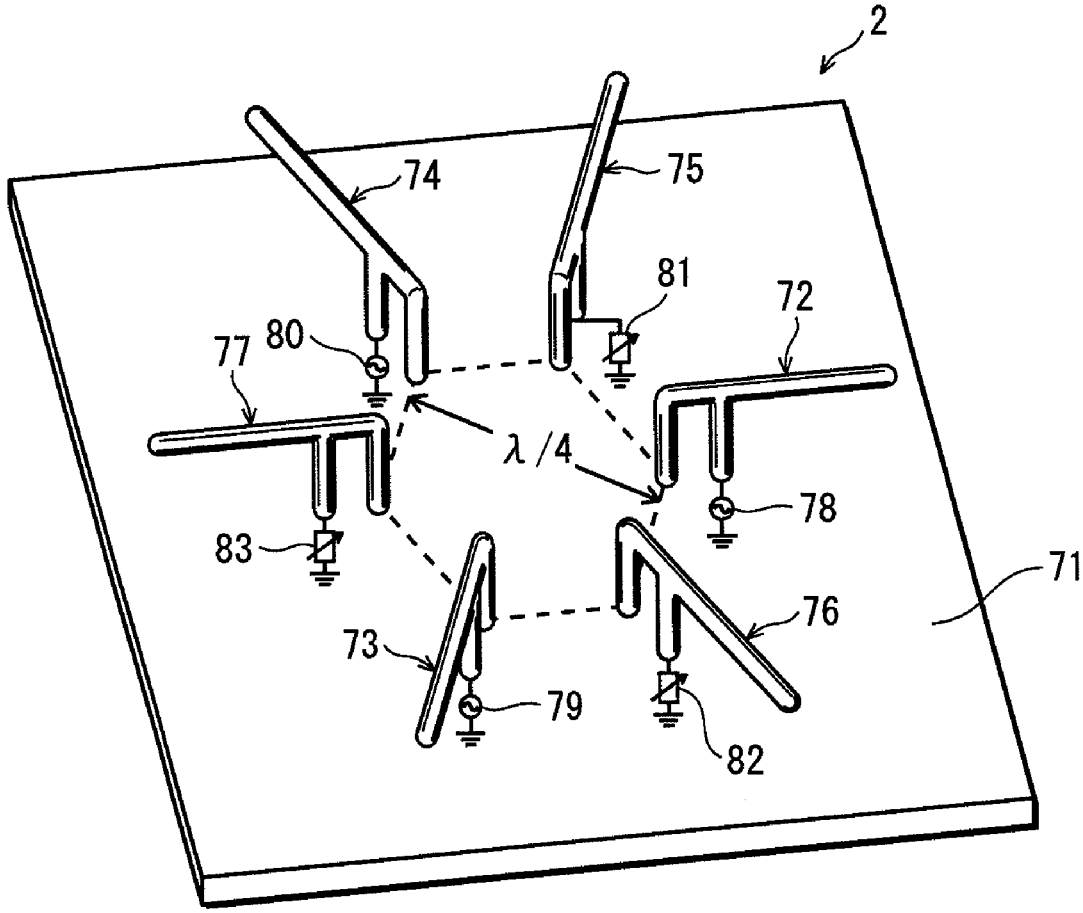
FIG. 16 shows an antenna structure of a second embodiment.

More specifically, in an antenna structure 2 pertaining to the second embodiment, three excited elements and three parasitic elements are arranged alternately, each on a different vertex of a regular hexagon on a ground plane 71. This configuration is illustrated in FIG. 16.

In the antenna structure 2, each side of the regular hexagon, on which the excited elements 72, 73 and 74 and the parasitic elements 75, 76 and 77 are arranged, is $\lambda/4\sqrt{3}$ long. The distance between each excited element, as well as the distance between each parasitic element, is $\lambda/4$.

The excited elements 72, 73 and 74 and the parasitic elements 75, 76 and 77 each have a shape of an inverted-F antenna, each of their impedance matching parts extending parallel to the corresponding diagonal of the regular hexagon passing through the center thereof.

A feed circuit (78, 79 and 80) is connected to one of the vertical conductors of each excited element (72, 73 and 74). On the other hand, a variable reactor (81, 82 and 83) is connected to one of the vertical conductors of each parasitic element (75, 76 and 77).

It is possible to make the excited elements 72, 73 and 74 function as a phased array, by changing the excitation amplitudes and the excitation phases of the signals fed by the feed circuits 78, 79 and 80. It is also possible to enable the parasitic elements 75, 76 and 77 to demonstrate the properties of a director and a reflector, by changing the reactance values of the variable reactors 81, 82 and 83. These features are the same as those of the antenna structure 1 pertaining to the first embodiment, and thus the descriptions thereof are omitted.

With the above configuration, the antenna structure 2 has more excited elements and parasitic elements than the antenna structure 1 pertaining to the first embodiment. Consequently, the adjustments of the excitation amplitudes, the excitation phases and the reactance values become complicated. Nonetheless, compared to the antenna structure 1, the antenna structure 2 can control its directivity with great subtlety, with the three excited elements functioning as the phased array, and the three parasitic elements as directors or the reflectors.

The antenna structure 2 occupies a larger space than the antenna structure 1 pertaining to the first embodiment. However, since the thickness of the antenna structure 2 is nearly the same as that of the antenna structure 1, the antenna structure 2 can be constructed low-profile, and thereby is beneficial for built-in use.

[Modifications of Second Embodiment]

Figure 17:
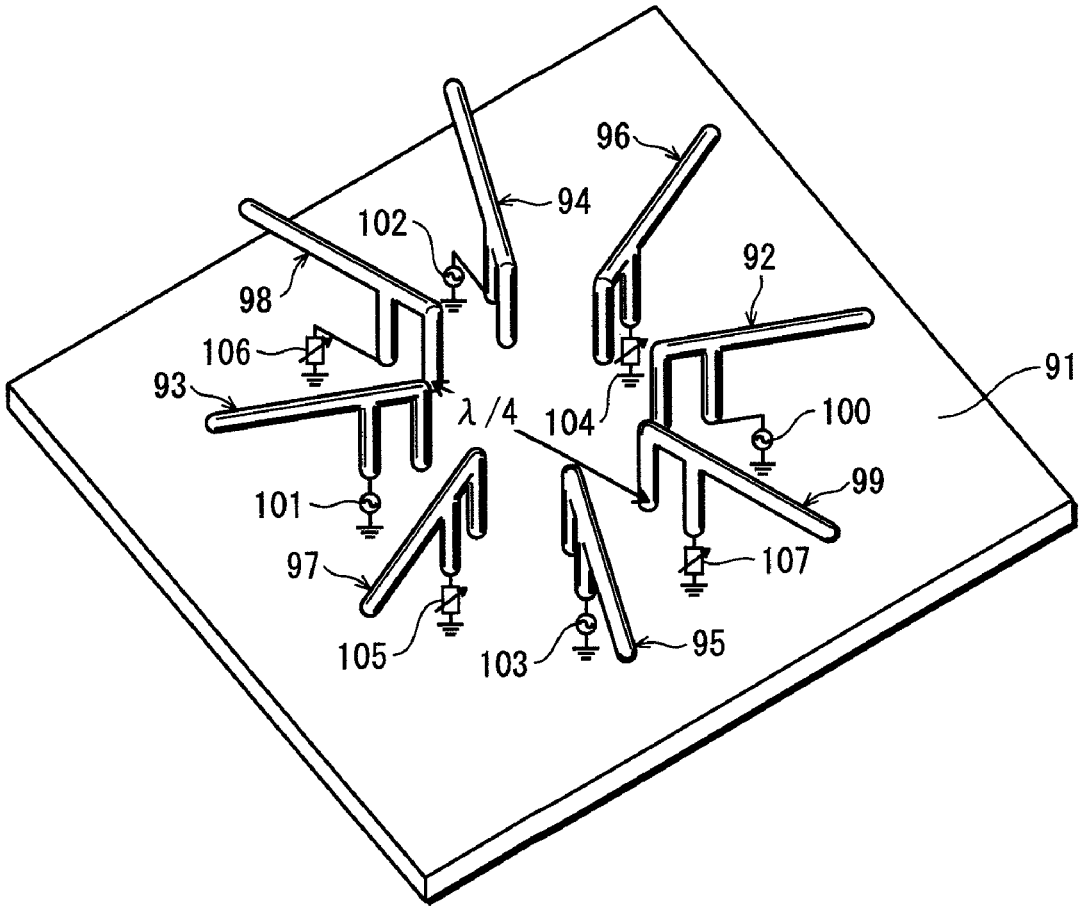
FIG. 17 shows one modification example of the second embodiment.

(1) In the configuration shown in FIG. 17, four excited elements and four parasitic elements are arranged alternately, each on a different vertex of a regular octagon on a ground plane 91. The distance between two excited elements standing on a diagonal passing through the center of the regular octagon is λ/4. Likewise, the distance between two parasitic elements standing on a diagonal passing through the center of the regular octagon is λ/4 as well.

A feed circuit (100, 101, 102 and 103) is connected to one of the vertical conductors of each excited element (92, 93, 94 and 95). On the other hand, a variable reactor (104, 105, 106 and 107) is connected to one of the vertical conductors of each parasitic element (96, 97, 98 and 99).

It is possible to make the excited elements 92, 93, 94 and 95 function as a phased array, by changing the excitation amplitudes and the excitation phases of the signals fed by the feed circuits 100, 101, 102 and 103. It is also possible to enable the parasitic elements 96, 97, 98 and 99 to demonstrate the properties of a director and a reflector, by changing the reactance values of the variable reactors 104, 105, 106 and 107. These features are the same as those of the antenna structure 1 pertaining to the first embodiment.

Figure 18:
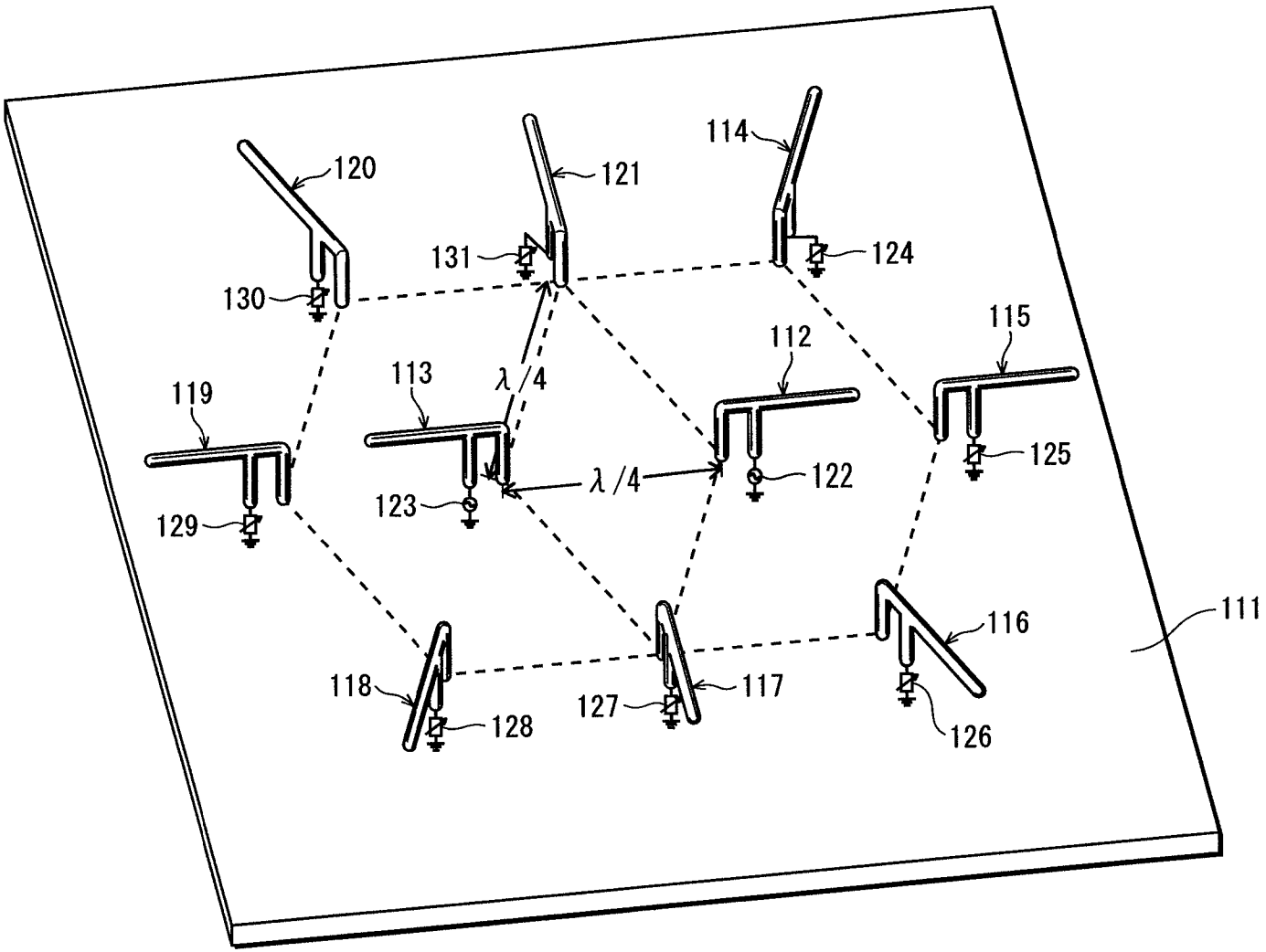
FIG. 18 shows another modification example of the second embodiment.

(2) In the configuration shown in FIG. 18, excited elements 112 and 113 are arranged at a distance of λ/4 from each other on a ground plane 111. Impedance matching parts of the excited elements 112 and 113 extend parallel to their alignment axis, but in the opposite direction. Assuming that the excited elements 112 and 113 each stand on the center of two different regular hexagons (i.e., on one of the vertices of the other regular hexagon), parasitic elements 114 through 121 are each arranged on a different one of the rest of the vertices of the two regular hexagons.

A feed circuit (122 and 123) is connected to one of the vertical conductors of each excited element (112 and 113). On the other hand, a variable reactor (124 through 131) is connected to one of the vertical conductors of each parasitic element (114 through 121).

It is possible to make the excited elements 112 and 113 function as a phased array, by changing the excitation amplitudes and the excitation phases of the signals fed by the feed circuits 122 and 123. It is also possible to enable the parasitic elements 114 through 121 to demonstrate the properties of a director and a reflector, by changing the reactance values of the variable reactors 124 through 131.

Third Embodiment

According to the configurations described in the above first and second embodiments and the modifications thereof, the inverted-F antenna element is used both as the excited element and the parasitic element. However, the antenna structure of the present invention is also constructible with other types of low-profile antenna elements. The third embodiment describes an antenna structure incorporating a patch antenna element, which is one example of the other types of low-profile antenna elements.

Figure 19:
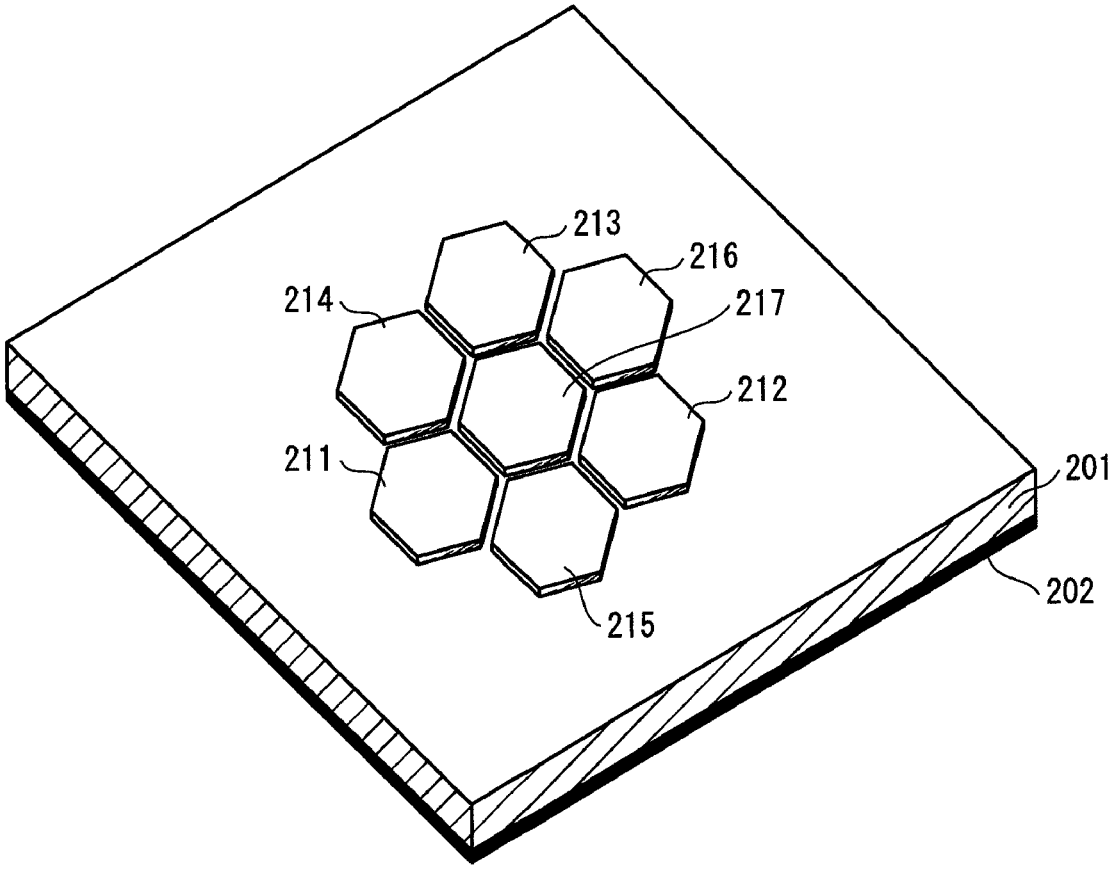
FIG. 19 is a perspective view of an antenna structure 3 pertaining to the present invention.

FIG. 19 is a perspective view of an antenna structure 3 pertaining to the present invention.

The antenna structure 3 is composed of a dielectric substrate 201, one surface thereof (hereinafter, "lower surface") attached to a ground plane 202, and the other (hereinafter, "upper surface") having excited elements 211 through 213, parasitic elements 214 through 216, and a central element 217 atop thereof.

The excited elements 211 through 213, the parasitic elements 214 through 216, and the central element 217 each have a patch antenna structure, which comprises a regular-hexagon-shaped plate conductor of the same dimension.

Figure 20:
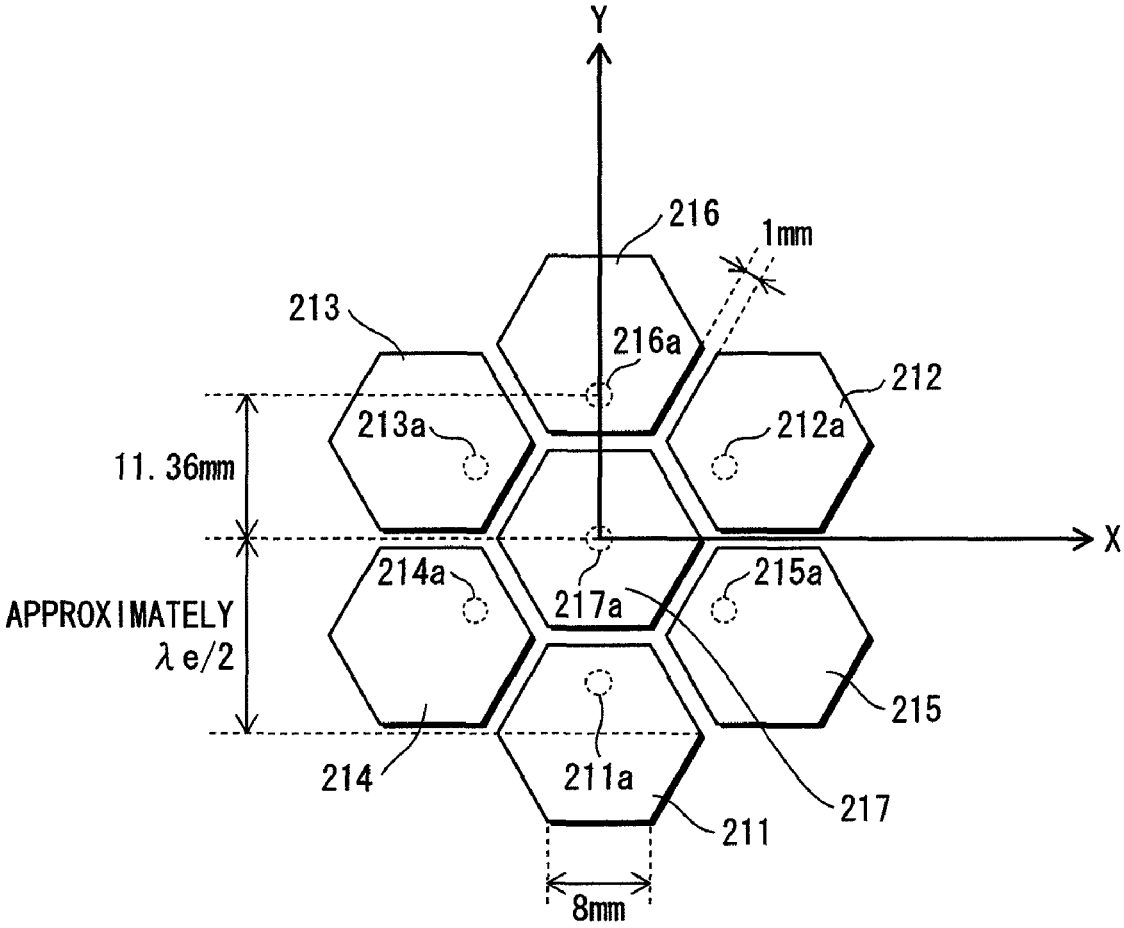
FIG. 20 shows the antenna structure 3 when viewed from above and perpendicular to a dielectric substrate 201.

FIG. 20 shows the antenna structure 3 when viewed from above and perpendicular to the dielectric substrate 201 having a given relative permittivity (∈r). Here, the central element 217 is arranged at the origin of the xy-coordinate on the dielectric substrate 201. With the positive direction of the x-axis regarded as 0°, the excited elements 211 through 213 are respectively arranged in the directions of 270°, 30° and 150°; the centers of their plate conductors are arranged at equal distances from the origin. On the other hand, the parasitic elements 214 through 216 are respectively arranged in the directions of 210°, 330° and 90°; the centers of their plate conductors are arranged at equal distances from the origin. Here, the distance between the origin and each center of the plate conductors of the excited/parasitic elements (211 through 216) is preferably adjusted to approximately λe/2 ($\lambda e=\lambda/\sqrt{\in r}$).

In the antenna structure 3 pertaining to the present embodiment, the 5.6 GHz frequency is used, and the dielectric substrate has a relative permittivity ∈r of 4.4 and a thickness of 1.5 mm. The regular-hexagon-shaped plate conductors, whose sides are each 8 mm long, are placed at a distance of 1 mm from one another. Consequently, the distance between the centers of two adjacent plate conductors is 14.9 mm.

In order to match the impedance on the feed side by using the 5.6 GHz frequency in the present embodiment, the feed circuits feed signals to vertical conductors 211*a* through 213*a* that are each located at a distance of 11.36 mm from the origin and vertically extend from the corresponding plate conductors toward the ground plane.

Similarly, vertical conductors 214*a* through 216*a* of the parasitic elements 214 through 216 are each located at a distance of 11.36 mm from the origin and vertically extend toward the ground plane. A variable reactor is connected to each of the vertical conductors 214*a* through 216*a*.

Located at the origin is a vertical conductor 217*a* of the central element 217, which vertically extends from the center of the corresponding plate conductor and is grounded to the ground plane 202.

The following describes the structures of the excited elements, the parasitic elements and the central element in detail.

Figure 21A:
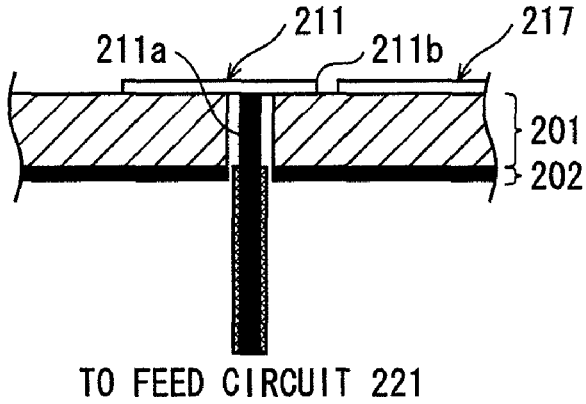
FIG. 21A schematically illustrates a cross-sectional structure of an excited element 211, the cross section including the y-axis and being perpendicular to the dielectric substrate 201, FIG. 21B schematically illustrates a cross-sectional structure of a parasitic element 214, the cross section passing through the centers of plate conductors of the parasitic element 214 and a central element 217 and being perpendicular to the dielectric substrate 201, and FIG. 21C schematically illustrates across-sectional structure of the central element 217, the cross section including the y-axis and being perpendicular to the dielectric substrate 201.

FIG. 21A schematically illustrates a cross-sectional structure of the excited element 211, the cross section including the y-axis and being perpendicular to the dielectric substrate 201. The excited element 211 is composed of the vertical conductor 211*a* and a plate conductor 211*b*. As shown in FIG. 20, the vertical conductor 211*a* (i) is on the line that connects the center of the plate conductor 211*b* and the origin, (ii) is 11.36 mm away from the origin, (iii) extends vertically from the plate conductor 211*b*, and (iv) penetrates through a via that is provided in the dielectric substrate 201 and the ground plate 202. A feed circuit 221 feeds a signal to the bottom end of the vertical conductor 211*a*.

As with the feed circuit 21 of the first embodiment, the feed circuit 211, which is connected to the vertical conductor 211*a*, includes a phase shifter, and can adjust the excitation amplitude and the excitation phase to a given value before feeding the signal to the excited element 211.

The excited elements 212 and 213 are constructed the same as the excited element 211.

Figure 21B:
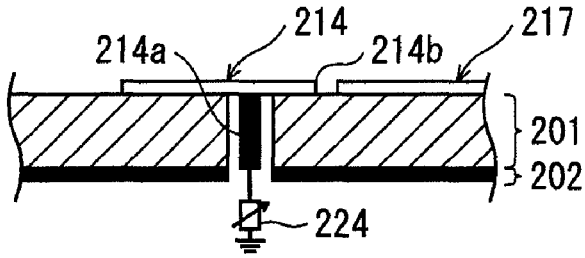

FIG. 21B schematically illustrates a cross-sectional structure of the parasitic element 214, the cross section passing through the centers of the plate conductors of the parasitic element 214 and the central element 217 and being perpendicular to the dielectric substrate 201. The parasitic element 214 is composed of the vertical conductor 214*a* and a plate conductor 214*b*. The vertical conductor 214*a* (i) is on the line that connects the center of the plate conductor 214*b* and the origin, (ii) is 11.36 mm away from the origin, (iii) extends vertically from the plate conductor 214*b*, and (iv) penetrates through a via that is provided in the dielectric substrate 201 and the ground plate 202. The bottom end of the vertical conductor 214*a* is connected to a variable reactor 224 and is further grounded. The variable reactor 224 is constructed the same as the variable reactor 23 of the first embodiment. The electrical length of the parasitic element 214 can be changed by adjusting the reactance value of the variable reactor 224 to a given value.

The parasitic elements 215 and 216 are constructed the same as the parasitic element 214.

Figure 21C:
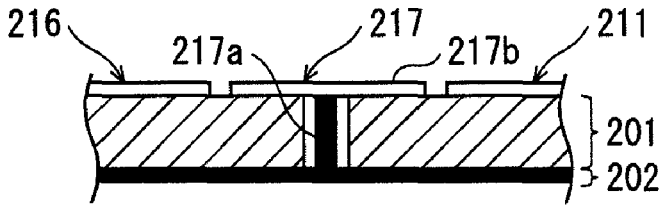

FIG. 21C schematically illustrates a cross-sectional structure of the central element 217, the cross section including the y-axis and being perpendicular to the dielectric substrate 201.

The central element 217 is composed of the vertical conductor 217*a* and a plate conductor 217*b*. The vertical conductor 217*a* is located at the center of the plate conductor 217*b* and vertically extends therefrom, penetrating through a via provided in the dielectric substrate 201. The bottom end of the vertical conductor 217*a* is grounded to the ground plane 202.

The foregoing is the description of the configuration of the antenna structure 3.

<Operation>

Figure 22:
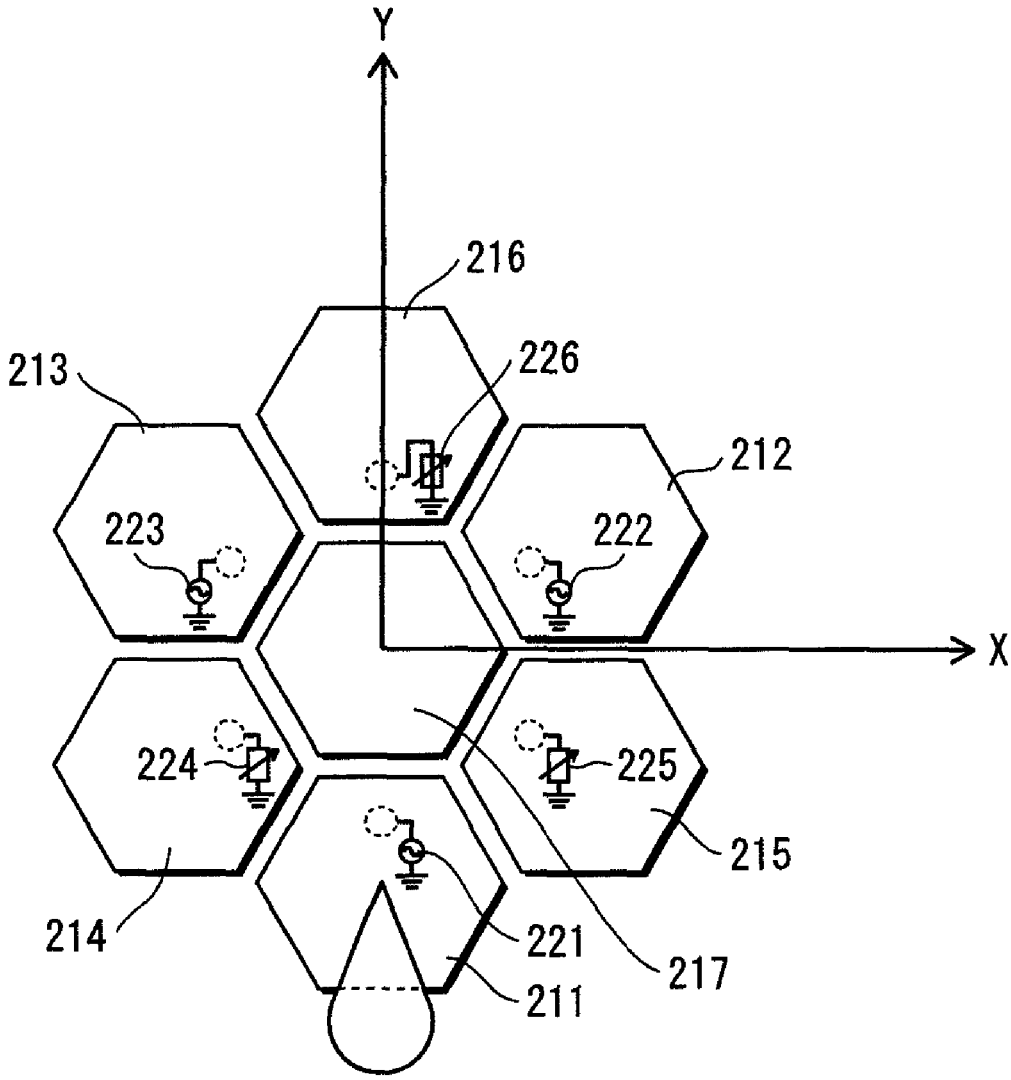
FIG. 22 schematically illustrates the principle of forming a beam in the direction of one excited element with the antenna structure 3.

Described below is the principle of forming a beam in the direction of one excited element in the above-described configuration. FIG. 22 schematically illustrates the principle of forming a beam in the direction of one excited element with the antenna structure 3.

The excited elements 211 through 213 can control the beam-forming direction in accordance with excitation phases ϕ221 through ϕ223 of the signals fed by the feed circuits. In other words, the excited elements 211 through 213 function as so-called phased array antennas.

Here, the beam to be formed in the direction of the excited element can be narrowed by adjusting the reactance values X224 through X226 of the variable reactors 224 through 226, such that (i) two parasitic elements located adjacent to and at opposite sides of the excited element, toward which the beam is to be formed, function as directors, and (ii) the parasitic element located across the origin from the excited element, toward which the beam is to be formed, function as a reflector.

More specifically, as shown in FIG. 22, when the excitation phases ϕ222 and ϕ223 of the signals fed by the feed circuits 222 and 223 are adjusted to appropriate values so as to cause the in-phase excitation of the excited elements 212 and 213, the excited elements 211 through 213 function as a phased array and form a beam along the y-axis. Furthermore, it is possible to form the beam to the direction of the excited element 211, by (i) reducing the reactance values X224 and X225 of the variable reactors that are connected to the parasitic elements 214 and 215 located adjacent to the excited element 211, and (ii) increasing the reactance value X226 of the variable reactor 226 that is connected to the parasitic element 216 located across the origin from the excited element 211.

Figure 23:
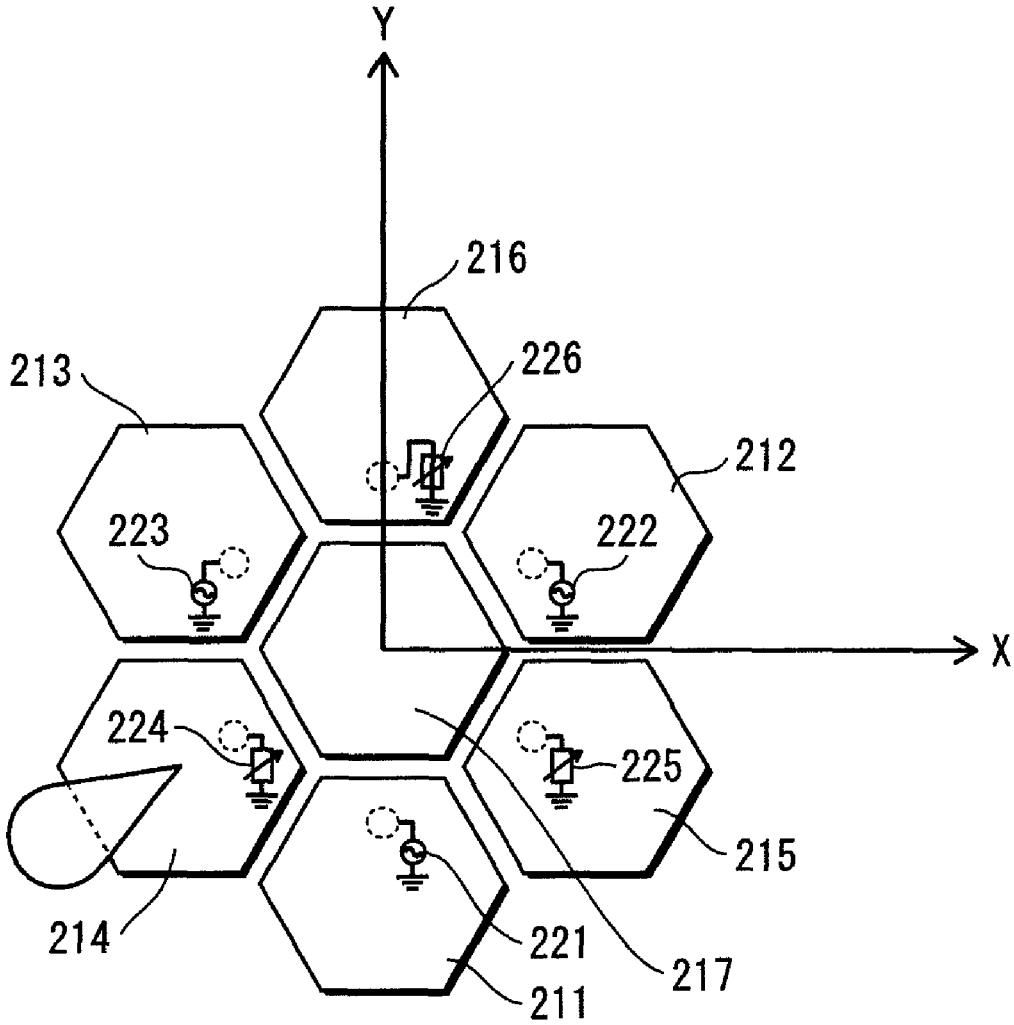
FIG. 23 schematically illustrates the principle of forming a beam in the direction of one parasitic element with the antenna structure 3.
Figure 24:
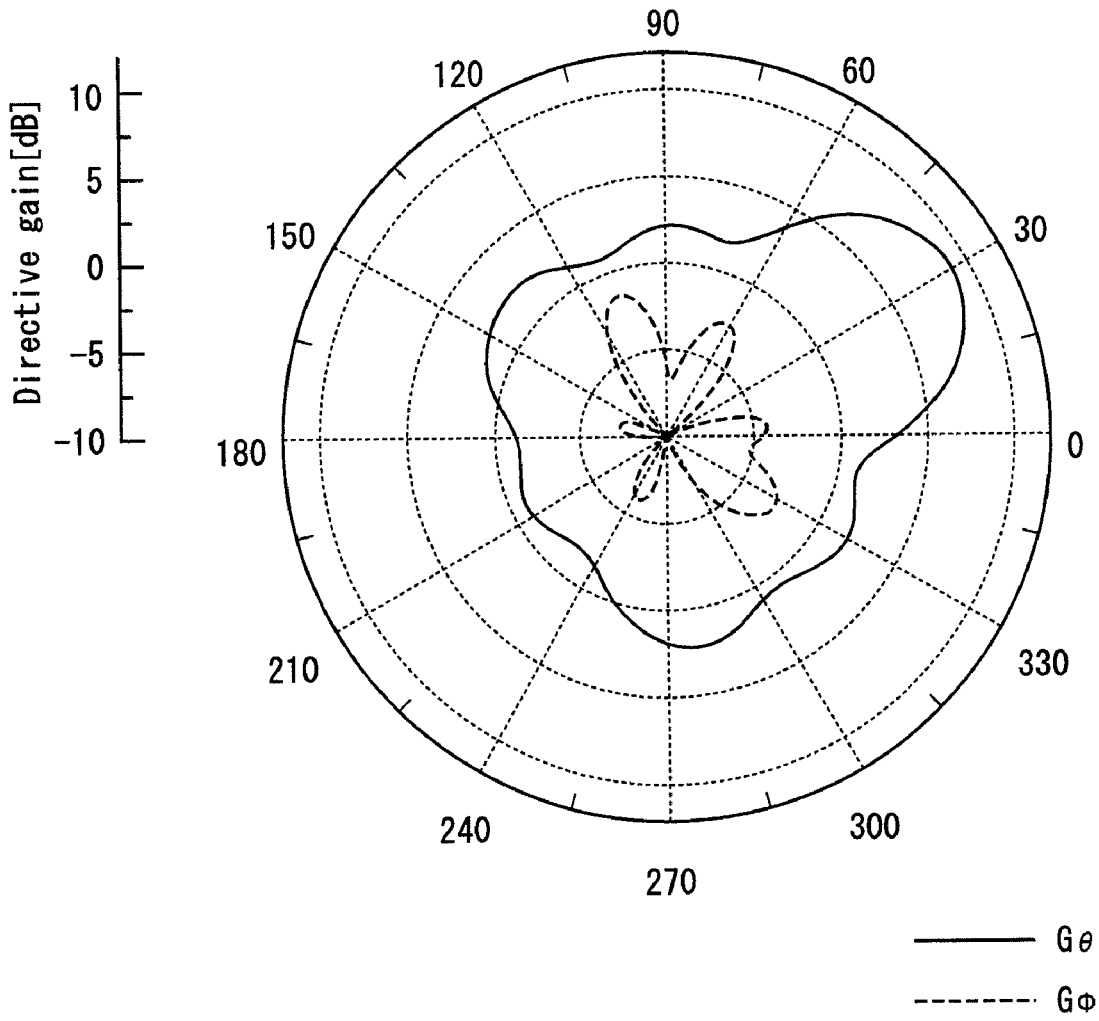
FIG. 24 illustrates a directive gain that is achieved when the beam is formed in the direction corresponding to the azimuthal angle of Φ=30°.
Figure 25:
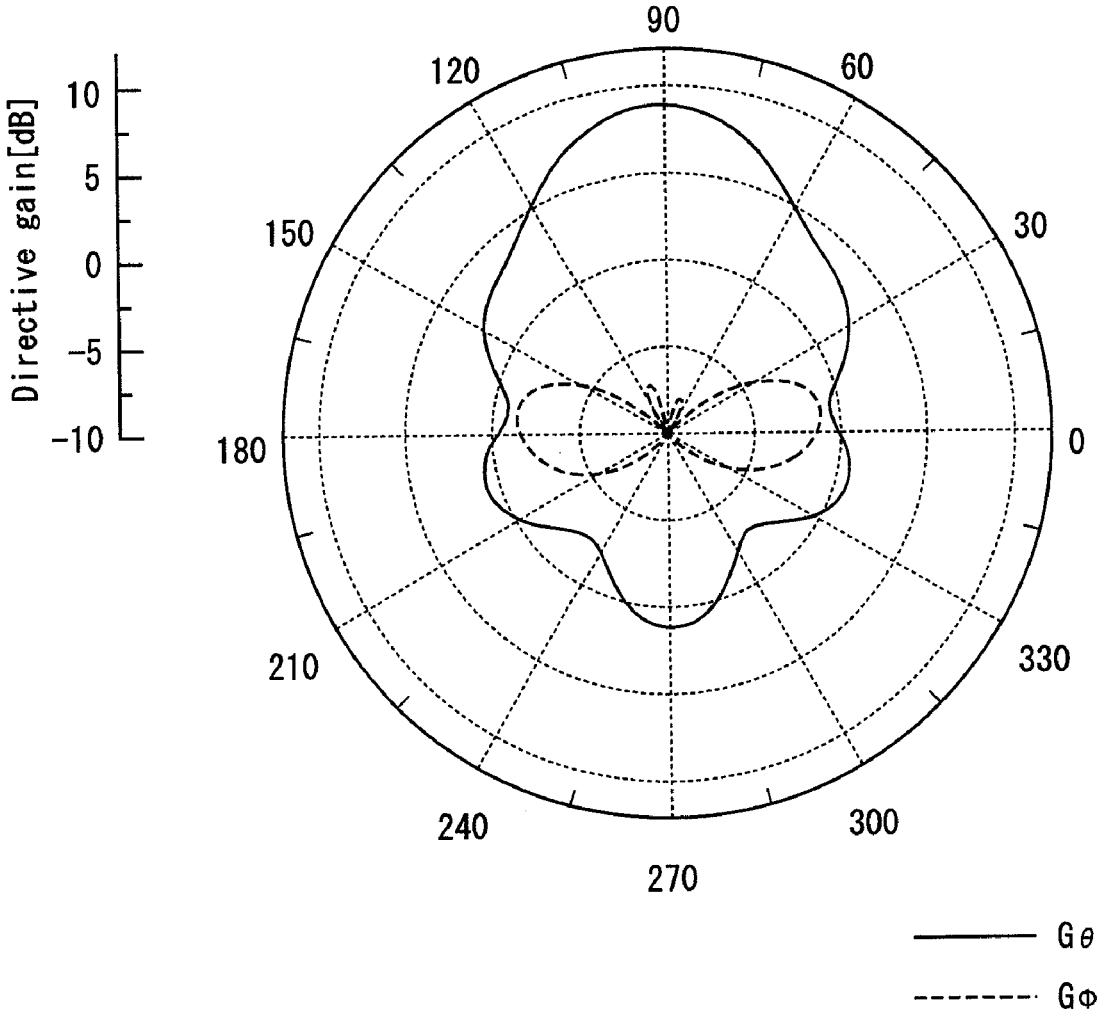
FIG. 25 illustrates a directive gain that is achieved when the beam is formed in the direction corresponding to the azimuthal angle of Φ=90°.
Figure 26:
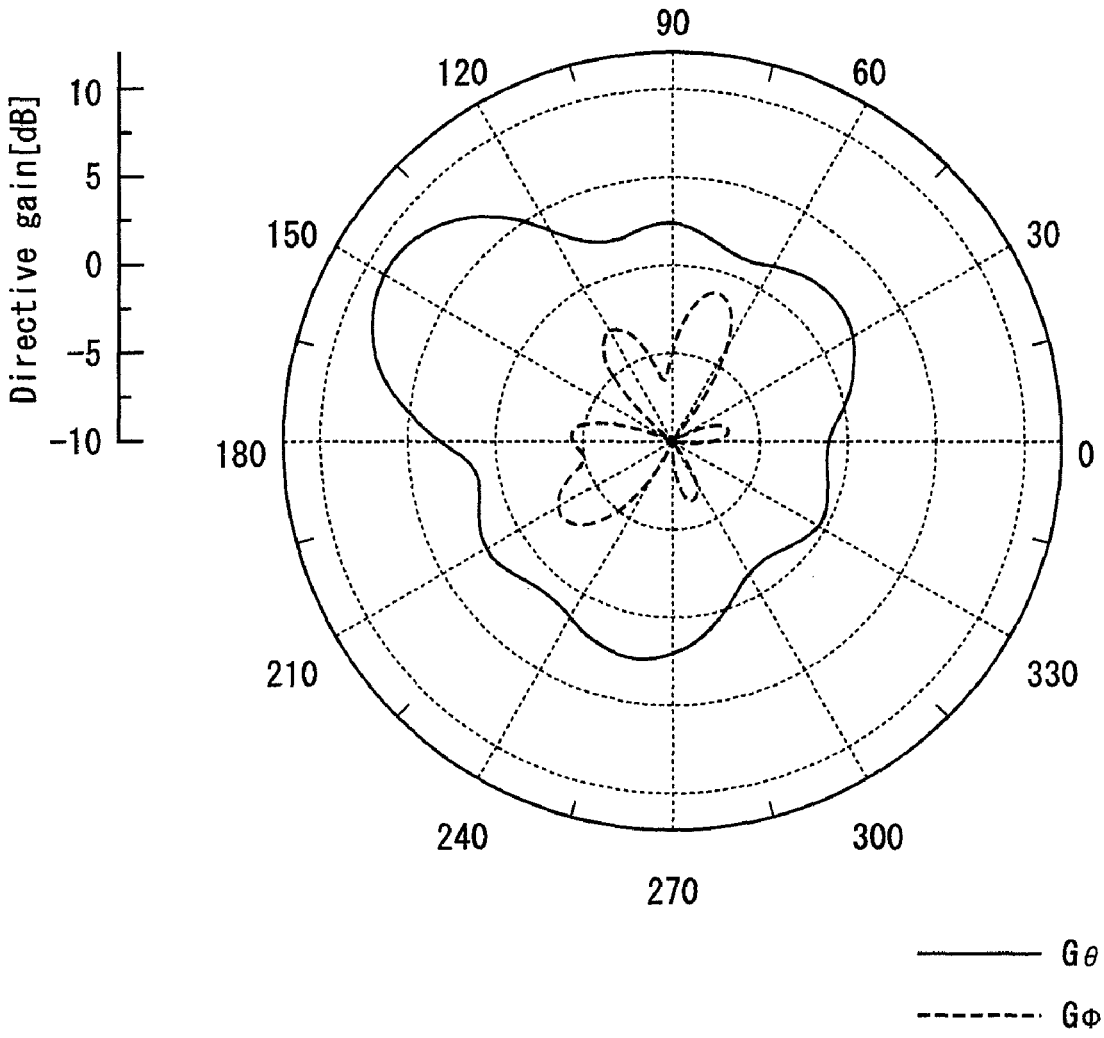
FIG. 26 illustrates a directive gain that is achieved when the beam is formed in the direction corresponding to an azimuthal angle of Φ=150°.
Figure 27:
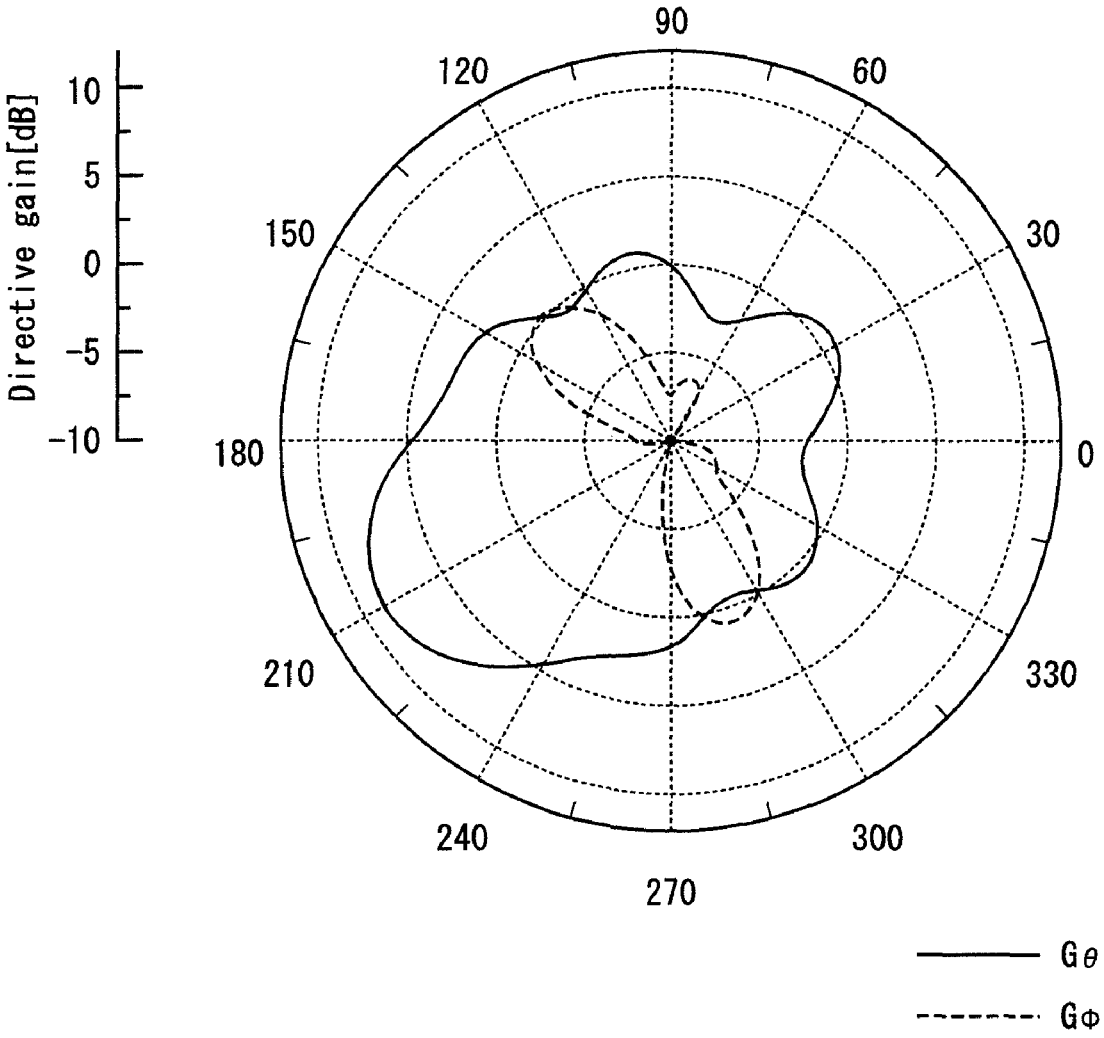
FIG. 27 illustrates a directive gain that is achieved when the beam is formed in the direction corresponding to an azimuthal angle of Φ=210°.
Figure 28:
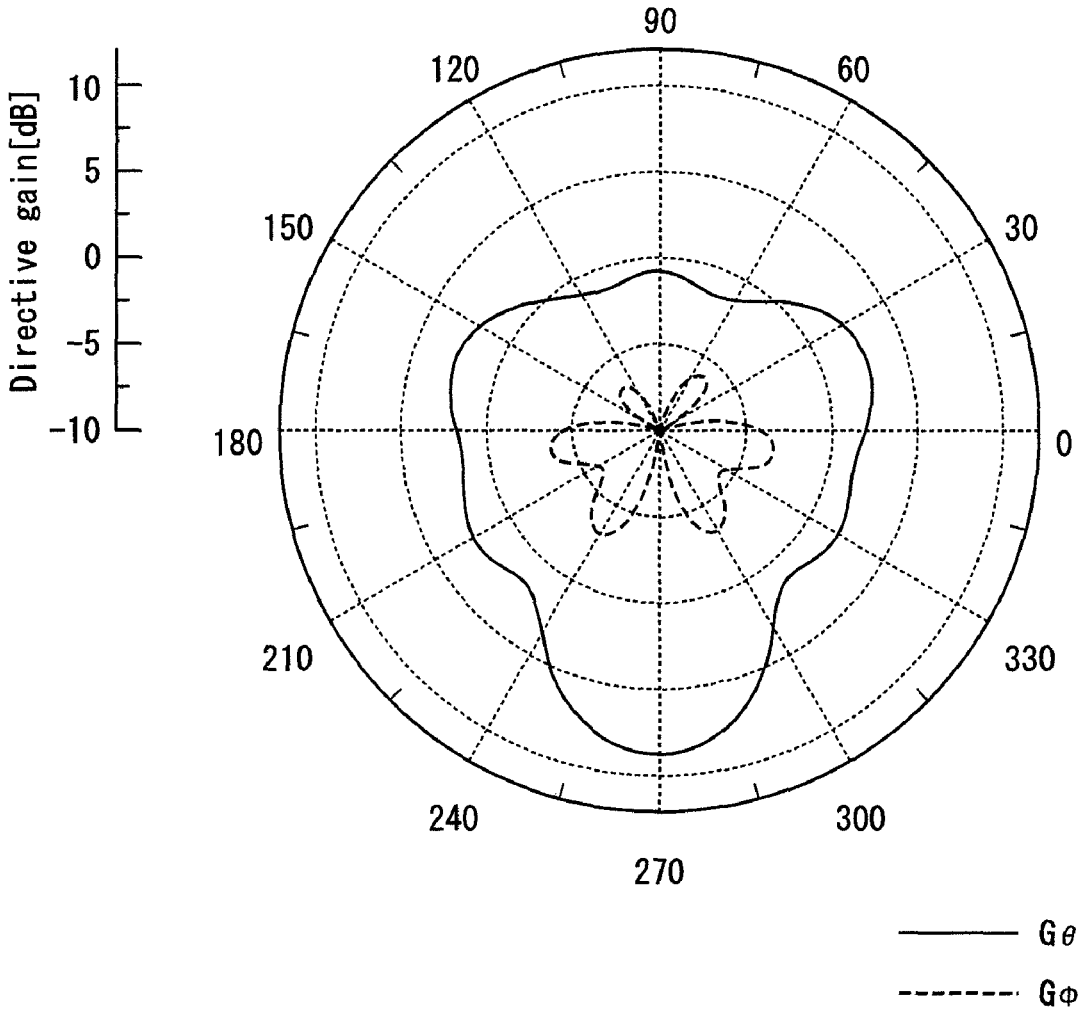
FIG. 28 illustrates a directive gain that is achieved when the beam is formed in the direction corresponding to an azimuthal angle of Φ=270°.
Figure 29:
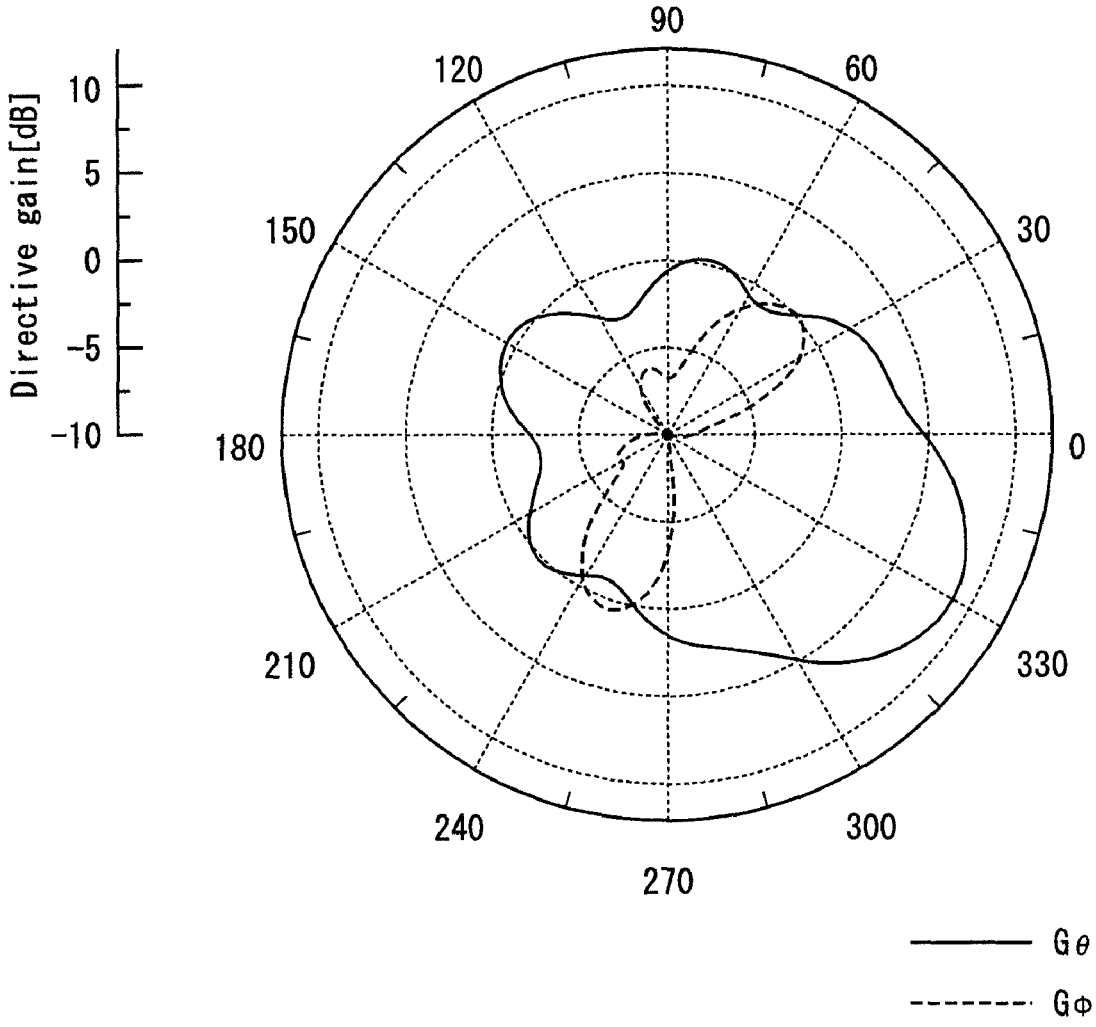
FIG. 29 illustrates a directive gain that is achieved when the beam is formed in the direction corresponding to an azimuthal angle of Φ=330°.
Figure 30:
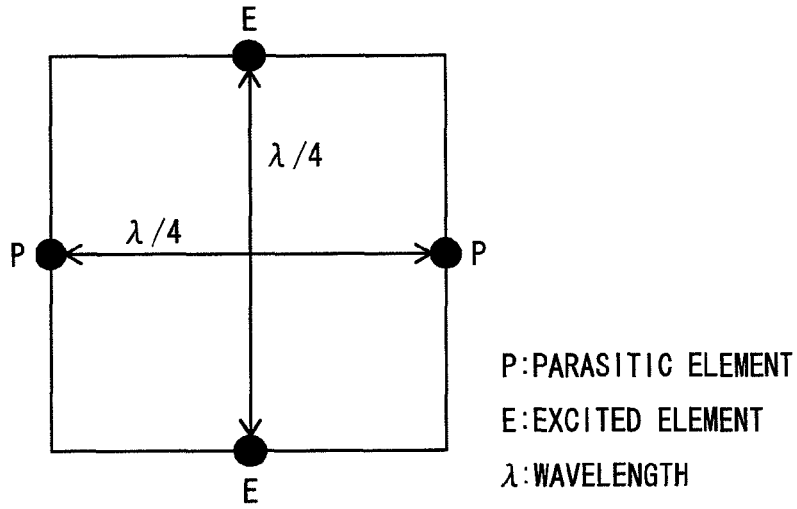
FIG. 30 shows an advantage of the antenna structure of the present invention.
Figure 30:
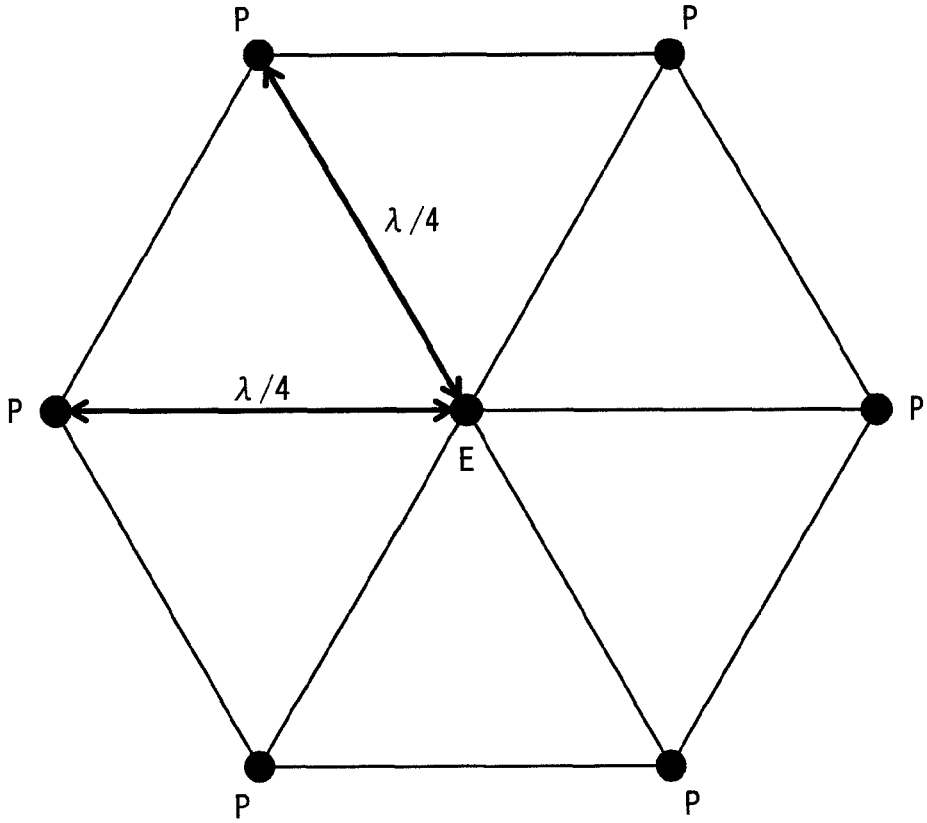

Next, described below is the principle of forming a beam in the direction of one parasitic element in the above-described configuration. FIG. 23 schematically illustrates the principle of forming a beam in the direction of one parasitic element with the antenna structure 3.

In order to form a beam in the direction of one of the excited elements, two of the parasitic elements 214 through 216 need to function as directors, while one of them needs to function as a reflector. In contrast, in order to form a beam in the direction of one of the parasitic elements, the parasitic element toward which the beam is to be formed needs to function as a director, and the rest of the two parasitic elements need to function as reflectors.

More specifically, as shown in FIG. 23, the excited elements 211 through 213 function as a phased array that form a beam along the axis that is rotated 60° from the x-axis toward the y-axis, when the following is satisfied: (i) the excitation phases ϕ221 and ϕ223 of the signals fed by the feed circuits 221 and 223 are identical, causing the in-phase excitation of the excited elements 211 and 213; and (ii) the excitation phase ϕ222 of the signal fed by the feed circuit 222 is set to a value that is appropriate for the excitation phases ϕ221 and ϕ223. Furthermore, it is possible to form the beam to the direction of the parasitic element 214, by (i) reducing the reactance value X224 of the variable reactor connected to the parasitic element 214, and (ii) increasing the reactance values X225 and X226 of the variable reactors 225 and 226 connected to the parasitic elements 215 and 216, which are located adjacent to and at opposite sides of the excited element 212 that lies across the origin from the parasitic element 214.

The following is a specific example of forming a beam with the antenna structure 3.

FIGS. 24 through 29 show directive gains of the antenna structure 3 under different parameter conditions. In these FIGs., the unit of ϕ221 through ϕ223 is [rad.] and the unit of X224 through X226 is [Ω]. Also, regarding (θ, Φ) as an angle from the Z-axis and an angle from the x-axis in a spherical coordinate system, respectively, Gθ and GΦ indicate the directive gain of the θ component and the directive gain of the Φ component in a conical plane with θ=60°, respectively.

By adjusting the parameters ϕ221 through ϕ223 and X224 through X226 to the values shown in FIGS. 24 through 29, the antenna structure 3 forms a beam of the θ component, which is a co-polarized wave, in the directions of 30°, 90°, 150°, 210°, 270° and 330° as shown in these FIGs. (the x-axis direction is regarded as 0°).

It can be seen from these FIGs. that the antenna structure 3 can control the beam-forming in an arbitrary direction in the horizontal xy-plane, by properly adjusting the values of the excitation phases ϕ221 through ϕ223 and the reactance values X224 through X226.

In the above-described configuration, with the use of an antenna element having a shape of a patch antenna, the antenna structure 3 can be constructed flat compared to the antenna structures 1 and 2 of the first and second embodiments.

[Modification of Third Embodiment]

Although the third embodiment has described the antenna structure having three excited elements and three parasitic elements that are all patch antenna elements, the present invention can be implemented in other configurations.

For example, the present invention can be implemented with an antenna structure having two excited elements and two parasitic elements that are all patch antenna elements, the excited and parasitic elements being located at even intervals and at equal distances from the center of the antenna structure. Or the antenna structure may have four or more excited/parasitic elements each.

[Other Modification]

The excited and parasitic elements used in the above embodiments are of the same shape. This, however, is not the limitation of the present invention. The present invention can be implemented by any combination of low-profile antenna elements, such as an inverted-F antenna element, an inverted-L antenna element, a T antenna element, and a patch antenna element.

INDUSTRIAL APPLICABILITY

As the antenna structure of the present invention is compact and takes up a small space, it is suitable for use in a mobile device as a built-in. This antenna structure can form a beam/null with great flexibility in an arbitrary direction in a horizontal plane, and thus is beneficial for use in a mobile communication device for a mobile communication system adopting the SDM technology.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An antenna structure comprising:

two excited elements that are (i) low-profile inverted-F antennas and (ii) arranged on a ground plane in such a manner that, out of an x-axis and a y-axis that perpendicularly intersect with each other at an origin of the xy-axes on the ground plane, the two excited elements are on the x-axis, one in a positive and the other in a negative direction of the x-axis;

two parasitic elements that are (i) low-profile inverted-F antennas and (ii) arranged on the ground plane in such a manner that the two parasitic elements are on the y-axis, one in a positive and the other in a negative direction of the y-axis;

two feed units each of which has been connected to and feeds a signal to a different one of the two excited elements, in such a manner that phases of the signals to be fed to the two excited elements are different from each other by a desired degree; and two variable reactors each of which (i) is connected to a different one of the two parasitic elements and (ii) in accordance with a reactance value thereof, changes an electrical length of the corresponding one of the two parasitic elements, wherein the two excited elements and the two parasitic elements have the same outer dimension and are at an equal distance from the origin of the xy-axes.

2. The antenna structure of claim 1, wherein each of the inverted-F antennas is composed of (i) two vertical conductors that stand perpendicular to the ground plane, (ii) a parallel conductor that is parallel to the ground plane and electrically connects top ends of the two vertical conductors, and (ii) a long conductor that extends parallel to the ground plane, one end thereof joined to one end of the parallel conductor, and the other end thereof sticking out in the air as an open end, the two vertical conductors and the parallel conductor are together referred to as an element body part, and the long conductor is referred to as an impedance matching part, in each excited element, the element body part is arranged on the x-axis, and the impedance matching part extends parallel to the y-axis, and in each parasitic element, the element body part is arranged on the y-axis, and the impedance matching part extends parallel to the x-axis.

3. The antenna structure of claim 2, wherein the impedance matching parts of the two excited elements, as well as the impedance matching parts of the two parasitic elements, extend in opposite directions from each other, and one of the impedance matching parts of the two excited elements and one of the impedance matching parts of the two parasitic elements, which are adjacent to each other, extend in such a manner that the former extends toward the latter and the latter extends away from the former, or vice versa.

4. The antenna structure of claim 3, wherein in each excited element, one of the two vertical conductors is connected to a feed source, and a total length from a bottom end of the one of the two vertical conductors to the open end is $\lambda/4$, $\lambda$ being a wavelength of a signal to be transmitted, and the excited elements and the parasitic elements are each arranged at a distance of $\lambda/8$ from the origin of the xy-plane.

5. The antenna structure of claim 4, wherein in each excited element and each parasitic element, the impedance matching part has been bent near the open end, in such a manner that a bent portion of the impedance matching part is parallel to the ground plane and the open end approaches the element body part of an adjacent one of the parasitic elements and the excited elements, respectively.

6. The antenna structure of claim 1, wherein each feed unit includes a phase shifter that can change a phase angle of a corresponding one of the signals to be fed to the excited elements to at least $n\pi/2$ radians, n being 1, 2, 3 and 4, and to a phase angle that is other than $n\pi/2$ radians.

7. The antenna structure of claim 1, wherein the excited elements and the parasitic elements are each replaced by an antenna element with the ground plane removed, and the antenna element is (i) formed by connecting an inverted-F antenna part and an F antenna part that together have mirror symmetry with respect to a hypothetical ground plane provided therebetween, and (ii) electrically equivalent to an inverted-F antenna arranged on the ground plane.

8. An antenna structure comprising:

n low-profile excited elements, n being an integer equal to or greater than 2;

n low-profile parasitic elements;

n feed units each of which has been connected to and feeds a signal to a different one of the n excited elements, in such a manner that phases of the signals to be fed to the n excited elements are different from each other by a desired degree; and n variable reactors each of which (i) is connected to a different one of the n parasitic elements and (ii) in accordance with a reactance value thereof, changes an electrical length of the corresponding one of the n parasitic elements, wherein provided that a polygon having 2n vertices is plotted on a ground plane and that the vertices are numbered clockwise starting at one of the vertices, each excited element is arranged on a different one of the vertices that are odd-numbered, whereas each parasitic element is arranged on a different one of the vertices that are even-numbered, and at least one of the excited elements and the parasitic elements is an inverted-L antenna, a T antenna or a patch antenna.

9. The antenna structure of claim 8, wherein the excited elements and the parasitic elements are each a patch antenna that includes a plate conductor, and in each excited element and each parasitic element, a center of the plate conductor is located at an equal distance from a center of the polygon.

10. The antenna structure of claim 9 further comprising a plate conductor, wherein with each excited element and each parasitic element arranged on the corresponding one of the vertices of the polygon plotted on the ground plane, an empty space is left in the center of the polygon, and the plate conductor, which is grounded to the ground plane, is arranged in the empty space.

* * * * *